US012607427B2

(12) United States Patent
Eriksson

(10) Patent No.: US 12,607,427 B2
(45) Date of Patent: Apr. 21, 2026

(54) ARRANGEMENT FOR FEEDING AMMUNITION TO A WEAPON

(71) Applicant: BAE Systems Hägglunds Aktiebolag, Örnsköldsvik (SE)

(72) Inventor: Claes Eriksson, Arnäsvall (SE)

(73) Assignee: BAE Systems Hägglunds Aktiebolag, Örnsköldsvik (SE)

( * ) Notice: Subject to any disclaimer, the term of this patent is extended or adjusted under 35 U.S.C. 154(b) by 110 days.

(21) Appl. No.: 18/775,884

(22) Filed: Jul. 17, 2024

(65) Prior Publication Data

US 2024/0377151 A1 Nov. 14, 2024

Related U.S. Application Data

(63) Continuation of application No. 17/768,783, filed as application No. PCT/SE2020/050975 on Oct. 13, 2020, now Pat. No. 12,072,164.

(30) Foreign Application Priority Data

Oct. 15, 2019 (SE) ..... 1951170-8

(51) Int. Cl.
*F41A 9/57* (2006.01)
*F41A 9/04* (2006.01)
(Continued)

(52) U.S. Cl.
CPC *F41A 9/57* (2013.01); *F41A 9/04* (2013.01); *F41A 23/34* (2013.01); *F41A 27/16* (2013.01)

(58) Field of Classification Search
CPC .... F41A 27/16; F41A 9/57; F41A 9/04; F41A 23/34
(Continued)

(56) References Cited

U.S. PATENT DOCUMENTS 2,819,780 A 1/1958 Fallon et al.
2,838,154 A * 6/1958 Van Fossen ..... B65G 11/103 193/25 AC
(Continued)

FOREIGN PATENT DOCUMENTS

CH 344339 A 1/1960
CN 1035717 A 9/1989
(Continued)

OTHER PUBLICATIONS

Extended European Search Report for European Application No. 20877340.8 mailed on Apr. 10, 2023, 9 pages.
(Continued)

*Primary Examiner* — James R Bidwell
(74) *Attorney, Agent, or Firm* — Morrison & Foerster LLP

(57) ABSTRACT

Disclosed is an arrangement for feeding ammunition to a weapon. The weapon is mounted to an elevation device arranged to allow elevation movement of the weapon about an elevation axis. The arrangement includes a feeding chute connected at one end to the weapon. The feeding chute includes a set of elements assembled together in a stacked configuration. The set of elements is arranged about a shaft configured to be concentrically arranged relative to the elevation axis so as to allow movement of individual elements of the set of elements about the shaft in connection to elevation movement of the weapon about the elevation axis. The invention also relates to a vehicle with an arrangement according to the present invention.

36 Claims, 15 Drawing Sheets

(51) Int. Cl.
*F41A 23/34* (2006.01)
*F41A 27/16* (2006.01)

(58) Field of Classification Search
USPC ..... 193/25 FT, 25 AC
See application file for complete search history.

(56) References Cited

U.S. PATENT DOCUMENTS

| | | | | | |
|---|---|---|---|---|---|
| 2,951,422 | A | * | 9/1960 | Bobkowski | F41A 9/04 89/33.14 |
| 3,563,357 | A | | 2/1971 | West | |
| 3,696,704 | A | * | 10/1972 | Backus | F41A 9/04 89/33.02 |
| 3,788,189 | A | | 1/1974 | Sachleben et al. | |
| 4,318,331 | A | | 3/1982 | Echtler et al. | |
| 4,416,184 | A | | 11/1983 | Erich | |
| 4,469,005 | A | | 9/1984 | Schaulin et al. | |
| 4,669,355 | A | | 6/1987 | Schmid et al. | |
| 4,840,110 | A | | 6/1989 | Fischer | |
| 4,947,728 | A | | 8/1990 | Muhlhausen et al. | |
| 5,076,138 | A | * | 12/1991 | Mannhart | F41A 9/04 89/34 |
| 5,245,907 | A | | 9/1993 | Gyre | |
| 8,752,466 | B1 | | 6/2014 | Howell et al. | |
| 10,591,233 | B2 | | 3/2020 | Colomine et al. | |
| 12,072,164 | B2 | * | 8/2024 | Eriksson | F41A 9/04 |
| 2002/0172420 | A1 | | 11/2002 | Nicolas | |
| 2003/0051599 | A1 | | 3/2003 | Lundqvist et al. | |
| 2009/0120271 | A1 | | 5/2009 | Diller et al. | |
| 2012/0152094 | A1 | | 6/2012 | Gonzalez | |
| 2019/0310039 | A1 | | 10/2019 | Baert | |

FOREIGN PATENT DOCUMENTS

| | | | | | |
|---|---|---|---|---|---|
| CN | 101680729 | A | | 3/2010 | |
| CN | 102564221 | A | | 7/2012 | |
| CN | 109690228 | A | | 4/2019 | |
| DE | 3204499 | A1 | | 8/1983 | |
| EP | 0201276 | A | | 11/1986 | |
| EP | 338301 | A1 | | 10/1989 | |
| EP | 1715282 | A1 | | 10/2006 | |
| EP | 2843350 | A | | 3/2015 | |
| GB | 590783 | A | | 7/1947 | |
| GB | 2153496 | A | | 8/1985 | |
| JP | S57-26400 | A | | 2/1982 | |
| JP | H03-195896 | A | | 8/1991 | |
| JP | H08-136185 | A | | 5/1996 | |
| JP | 2001041687 | A | | 2/2001 | |
| KR | 20070030161 | A | | 3/2007 | |
| WO | WO-1998055818 | A1 | | 12/1998 | |
| WO | WO-2021076031 | A1 | * | 4/2021 | F41A 9/57 |

OTHER PUBLICATIONS

Feng et al., (2013). "Novel rotary warehouse track parameterization design," Sichuan Industrial Procedures, 9:25-27. English abstract.
International Search Report and Written Opinion for International Application No. PCT/SE2020/050975 mailed on Dec. 12, 2020, 14 pages.
Liang et al., (2015). "Research on structure of revolving type bullet feeder," Journal of Fire Gun Emission and Control, 36(4):19-22. English abstract.
Swedish Search Report for Swedish Application No. SE1951170-8 mailed on Mar. 9, 2020, 8 pages.

* cited by examiner

A-A

C-C

B-B

D-D

ARRANGEMENT FOR FEEDING AMMUNITION TO A WEAPON

CROSS-REFERENCE TO RELATED APPLICATIONS

This application is a continuation of U.S. application Ser. No. 17/768,783, filed Apr. 13, 2022, which is a national stage application under 35 U.S.C. § 371 of International Application No. PCT/SE2020/050975, filed internationally on Oct. 13, 2020, which claims priority to SE 1951170-8, filed Oct. 15, 2019. The entire contents of each priority application is incorporated by reference herein.

FIELD OF THE DISCLOSURE

The present invention relates to an arrangement for feeding ammunition to a weapon. The present invention also relates to a vehicle.

BACKGROUND OF THE DISCLOSURE

Combat vehicles such as infantry fighting vehicles or tanks may be equipped with a weapon system associated with a turret, wherein the weapon system comprises a weapon attached to the turret. The ammunition is normally configured to be fed to the weapon from an ammunition magazine via some kind of flexible chute. Such a chute may be configured to provide both twisting and bending abilities in order to facilitate feeding of ammunition to the weapon. Space for weapon systems may be an issue, particularly for weapon systems associated with a turret configured to house parts of the weapon system including such flexible chutes requiring certain space.

There is thus a need to provide an arrangement for feeding ammunition to a weapon.

OBJECTS OF THE INVENTION

An object of the present invention is to provide an arrangement for feeding ammunition to a weapon which facilitates a compact solution.

Another object of the present invention is to provide a vehicle comprising such an arrangement which facilitates a compact solution.

SUMMARY OF THE DISCLOSURE

These and other objects, apparent from the following description, are achieved by an arrangement for feeding ammunition to a weapon and a vehicle as set out in the appended independent claims. Preferred embodiments of the arrangement are defined in appended dependent claims.

Specifically an object of the invention is achieved by an arrangement for feeding ammunition to a weapon. The weapon is mounted to an elevation device arranged to allow elevation movement of the weapon about an elevation axis. The arrangement comprises a feeding chute connected at one end to the weapon. The feeding chute comprises a set of elements assembled together in a stacked configuration. The set of elements is arranged about a shaft configured to be concentrically arranged relative to the elevation axis so as to allow movement of individual elements of the set of elements about said shaft in connection to elevation movement of the weapon about the elevation axis.

By thus providing such a feeding chute with elements arranged about a shaft concentrically arranged relative to the elevation axis a compact feeding chute may be obtained. This is due to the fact that the individual elements of the feeding chute hereby only need to be pivoted about the shaft, i.e. only in a plane essentially orthogonal to the elevation axis in order to feed the ammunition through the feeding chute to the weapon. This facilitates having the individual elements tightly stacked together. Thus, the distance between the individual elements may be short since there is no need to bend the elements relative to each other. This also facilitates having the individual elements assembled together in a stacked configuration with the individual elements arranged a certain distance from each other in the axial direction of the shaft. This, further facilitates a feeding chute requiring low resistance in order to feed ammunition through the feeding chute within the entire elevation range of the weapon.

According to an embodiment of the arrangement, the feeding chute, at the end opposite to the end connected to the weapon, is configured to be fixedly attached to a guiding chute for guiding the ammunition from a magazine to the feeding chute. Hereby feeding of ammunition from the end opposite to the end connected to the weapon, i.e. to the weapon, may be easily obtained independent of elevation angle of the weapon, in that the ammunition may be introduced to the feeding chute via e.g. a connected guiding chute being fixed.

According to an embodiment of the arrangement, the feeding chute comprises a first end element configured to be closest to the weapon, the first end element being configured to be pivoted about the shaft corresponding to the elevation movement of the weapon about the elevation axis. Hereby feeding of ammunition to the weapon may be easily obtained independent of elevation angle of the weapon.

According to an embodiment of the arrangement, the feeding chute comprises a second end element configured to be furthest away from the weapon, the second end element being configured to be essentially fixed so that it is at the same position independently of elevation angle of the weapon thus connected to the feeding chute. Hereby feeding of ammunition from the end opposite to the end connected to the weapon, i.e. to the weapon, may be easily obtained independent of elevation angle of the weapon, in that the ammunition may be introduced to the feeding chute via e.g. a connected guiding chute being fixed.

According to an embodiment of the arrangement, the elements of the set of elements between the first end element and the second end element are gradually mutually displaceable. Hereby feeding of ammunition through the feeding chute may be efficiently obtained in that the individual elements may be mutually displaced based on elevation angle so as to allow ammunition to be fed through opening/openings of the feeding chute.

According to an embodiment the arrangement may comprise an element displacement control arrangement for controlling mutual displacement of the individual elements of the set of element of the feeding chute arranged in connection to a front side, i.e. the side facing in the firing direction of the weapon, or an opposite rear side of the feeding chute. According to an embodiment of the arrangement, the element displacement control arrangement may comprise a spring member configured to be fixed to an end element and comprising a spring rod configured to run through the individual elements from one end element to an opposite end element and being configured to control mutual displacement of the individual elements of the set of element of the feeding chute in connection to elevation movement of the weapon.

According to an embodiment of the arrangement, the individual elements movable about said shaft are configured to be rotated about the shaft a certain angle relative to an adjacent element so as to allow feeding of ammunition through the feeding chute at all elevation angles of the elevation device. Hereby the rotation of the individual elements may advantageously be set to a maximum rotation angle so that the displacement relative to adjacent elements is such that ammunition may be fed through the feeding chute without interruption and thus easily and efficiently obtained. The number of elements of the set of elements will thus be such that, with such a maximum rotation angle of individual elements, the feeding chute with the set of elements movably arranged about the shaft will facilitate feeding of ammunition through the feeding chute at all elevation angle of the weapon.

According to an embodiment of the arrangement, the feeding chute is configured to provide at least one channel by means of said elements, through which at least one channel ammunition is configured to be fed, wherein the individual elements movable about said shaft are configured to be arranged a certain distance relative to each other in the axial direction of said shaft. The feeding chute comprises a gliding arrangement comprising a set of gliding members arranged in connection to the individual elements and configured to run in the feeding direction so as to facilitate feeding of ammunition through the respective individual elements of the feeding chute. Hereby easy and efficient feeding of ammunition through the feeding chute is facilitated by means of the set of gliding members. Hereby a compact feeding chute may be obtained with a low number of individual elements.

According to an embodiment of the arrangement, individual gliding members of the gliding arrangement comprises gliding rails overlappingly arranged in connection to individual elements so as to allow relative movement of said gliding rails for facilitating gradual mutual displacement of individual elements of the set of elements when rotated about said shaft. By means of such gliding rails overlappingly arranged in connection to individual elements, rotational movement of individual elements relative to each other and feeding of ammunition through the feeding chute with low resistance may be efficiently obtained.

According to an embodiment of the arrangement, the feeding chute has a connection side for connecting the feeding chute to the weapon, and an opposite receiving side, the feeding chute having a front side essentially facing the firing direction of the weapon, when the feeding chute is connected to the weapon, and an opposite rear side, wherein the arrangement comprises a rotation limit arrangement arranged in connection to the front side or rear side of the feeding chute configured to limit rotation of the individual elements about said shaft, wherein the rotation limit arrangement comprises tracks in connection to individual elements of said set of elements, said tracks running in a direction essentially orthogonal to the extension of the shaft so as to facilitate said limited rotation of the individual elements about said shaft. Hereby efficient control of the movements of the individual elements of the set of elements is facilitated such that feeding of ammunition through the feeding chute is facilitated.

According to an embodiment of the arrangement, the rotation limit arrangement comprises a set of distance members configured to connect said set of elements so as to limit the rotation of the individual elements about said shaft. Hereby efficient limitation of the rotational movements of the individual elements of the set of elements is facilitated such that feeding of ammunition through the feeding chute is facilitated.

According to an embodiment the arrangement may comprise a track member arranged in connection to a front side, i.e. the side facing in the firing direction of the weapon, or an opposite rear side of the feeding chute configured to run through the set of elements so as to limit the rotation of the individual elements about the shaft. The track member is configured to be arranged on the opposite side relative to the arrangement of the element displacement control arrangement. According to an embodiment the arrangement may comprise distance members arranged in connection to the track member and configured to hold the individual elements together in the axial direction, i.e. direction of the shaft, and limit the relative movement of the elements by means of the track member.

According to an embodiment of the arrangement, the second end element furthest away from the weapon is configured to have an angle within a range between the maximum elevation angle and minimum elevation angle of the weapon.

Hereby the number of elements of the set of elements of the feeding chute may be minimized and thus optimizing the compactness of the feeding chute. This, since only half of the elevation angle is required for the feeding chute for elevation corresponding to rising of the weapon to the highest elevation angle and lowering to the lowest elevation angle. Elevation of the weapon, i.e. gun barrel of the weapon, upwardly usually corresponds to an elevation angle substantially greater than the elevation angle for lowering the weapon. This means that, for a weapon in a horizontal position, given that the vehicle is in a horizontal position, the angle of the second end element has a certain upward direction in the forward direction of gun barrel of the weapon.

According to an embodiment of the arrangement, the set of elements are pivotably journalled about said shaft. Hereby easy and efficient rotation of individual element about the shaft is facilitated.

According to an embodiment of the arrangement, the feeding chute comprises an upper channel for feeding ammunition and a lower channel for feeding ammunition, said shaft being arranged between the upper and lower channel.

According to an embodiment of the arrangement, the feeding chute, in connection to said one end of the feeding chute, comprises a fastening arrangement for attaching the feeding chute to the weapon. Hereby easy and efficient rotation, corresponding to the elevation movement of the weapon, of the first end element of the feeding chute is facilitated.

According to an embodiment of the arrangement, the ammunition is configured to be guided from an essentially upright position in the magazine to an essentially lying position at the feeding chute via the guiding chute. This may be a space efficient way of guiding ammunition to the feeding chute within a turret.

According to an embodiment of the arrangement, the arrangement is intended for a vehicle mounted weapon system, the weapon system S comprising the weapon mounted to a turret via the elevation device.

According to an embodiment of the arrangement, the arrangement comprising the feeding chute, and the guiding channel to which the feeding chute is connected are configured to be arranged within said turret.

Specifically an object of the invention is achieved by a vehicle comprising an arrangement for feeding ammunition from a magazine to a weapon of a weapon system mounted on the vehicle as set out herein.

According to an embodiment, the vehicle is a tracked vehicle. According to an embodiment the vehicle is a combat vehicle.

BRIEF DESCRIPTION OF THE DRAWINGS

For a better understanding of the present disclosure reference is made to the following detailed description when read in conjunction with the accompanying drawings, wherein like reference characters refer to like parts throughout the several views, and in which.

DETAILED DESCRIPTION OF THE DISCLOSURE

Herein the term "in a stacked configuration" in connection to " . . . a set of elements assembled together in a stacked configuration" may refer to the elements being assembled together closely, i.e. adjacent element being relatively tightly arranged relative to each other, or elements being assembled together with a certain distance relative to adjacent elements. When a set of elements are assembled together in a stacked configuration when being arranged a certain distance from adjacent elements, the elements are connected to gliding members configured to run in connection to the set of elements so as to facilitate feeding ammunition through the feeding chute.

Figure 1:
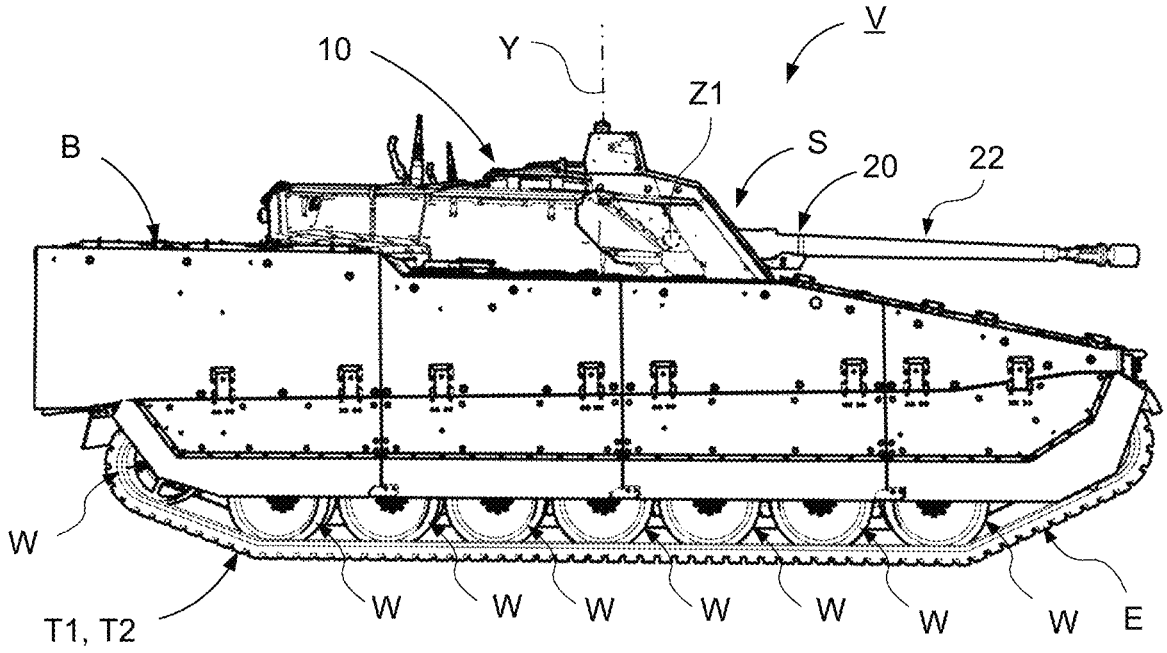
FIG. 1 schematically illustrates a side view of a tracked vehicle according to an embodiment of the present disclosure.

FIG. 1 schematically illustrates a side view of a tracked vehicle V according to an aspect of the present disclosure. The exemplified vehicle V is constituted by a combat vehicle. The tracked vehicle V comprises a vehicle body B, which according to an aspect of the present disclosure comprises the chassis of the vehicle V and bodywork.

The tracked vehicle V comprises a track assembly pair T1, T2 being suspendedly connected to the vehicle body B. The track assembly pair comprises a right track assembly T1 and a left track assembly T2 for driving the vehicle, each track assembly comprising a drive means driven endless track E arranged to run over a set of wheels W of the track assembly.

Even if the illustrated motor vehicle V is a tracked vehicle the motor vehicle V may according to other embodiments of the invention be constituted by a wheeled vehicle.

The vehicle V is equipped with a turret 10. The turret 10 is arranged on top of the vehicle V. The turret 10 is rotatable about an axis Y of rotation orthogonal to the longitudinal extension of the vehicle V and orthogonal to the transversal extension of the vehicle V.

The vehicle V is configured to be equipped with a weapon system S having a weapon 20. The weapon 20 is mounted to the turret 10. The weapon 20 of the weapon system S is thus allowed to rotate by means of rotating the turret 10 about the axis Y.

The weapon 20 is configured to be connected to an elevation device, e.g. a so called weapon cradle, connected to the turret 10. The elevation device may be an elevation device 30 illustrated in FIGS. 3A-3B, 4A-4B and FIG. 5. The weapon 20 is configured to be raised and lowered, i.e. provide an elevation movement, about an elevation axis Z1, illustrated in FIG. 1, by means of the elevation device. The weapon 20 comprises a gun barrel 22. The gun barrel 22 of the weapon 20 is configured to be raised and lowered, i.e. provide an elevation movement, about the elevation axis Z1.

Figure 2:
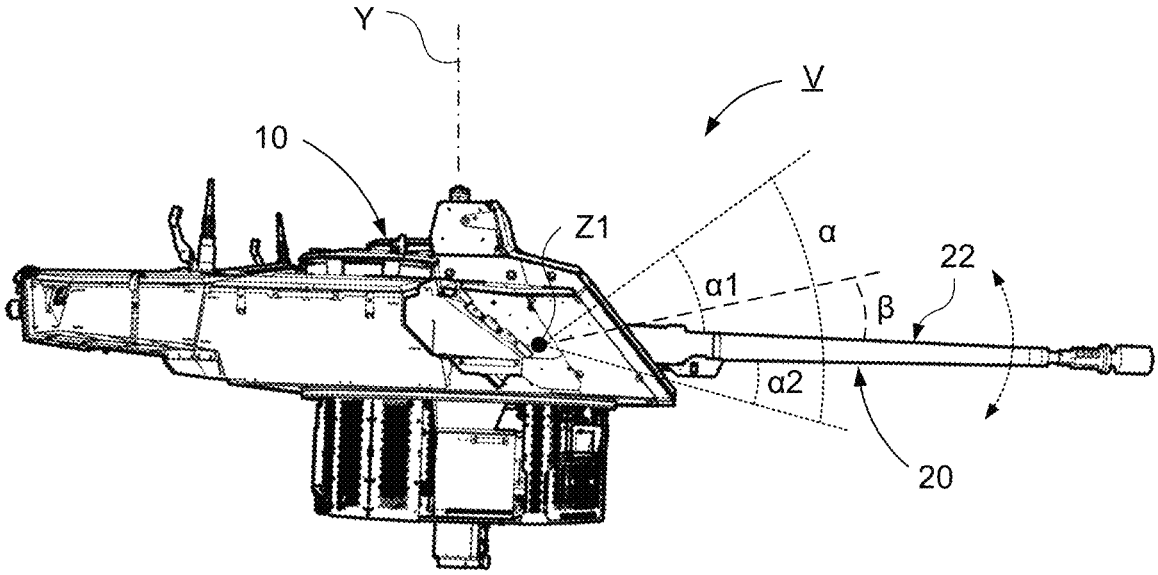
FIG. 2 schematically illustrates a side view of a turret with a weapon system having a weapon according to an embodiment of the present disclosure.

FIG. 2 schematically illustrates a side view of the turret 10 with the weapon system S having a weapon 20 according to an embodiment of the present disclosure.

As mentioned above with reference to FIG. 1, the weapon 20 is configured to be connected to an elevation device, e.g. an elevation device 30 illustrated in FIGS. 3A-3B, 4A-4B and 5. The weapon 20 is configured to be raised and lowered, i.e. provide an elevation movement, about an elevation axis Z1 by means of the elevation device, e.g. weapon cradle.

The weapon 20 is configured to be raised and lowered within an elevation angle $\alpha$. The weapon 20 is configured to be raised from a position corresponding to the longitudinal extension of the vehicle V, i.e. a horizontal position when the vehicle is in a horizontal position, an angle $\alpha$1, and lowered from that position an angle $\alpha$2.

Figure 3A:
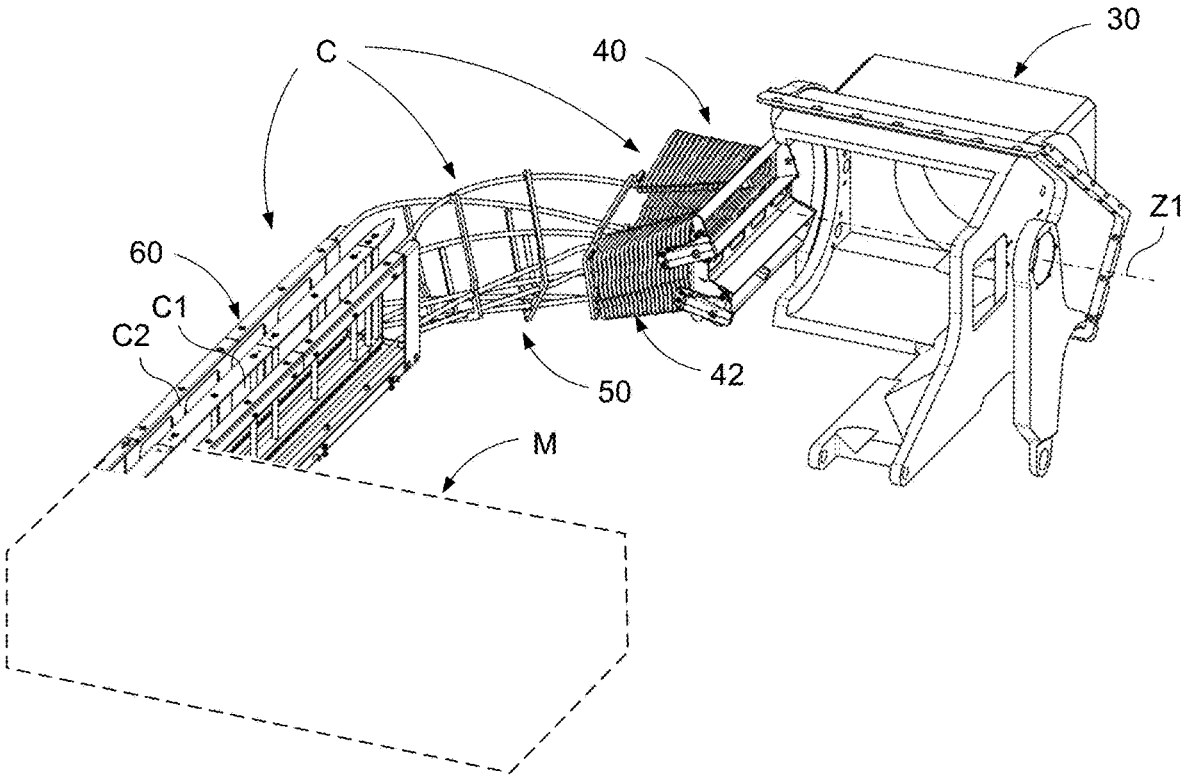
FIG. 3A schematically illustrates a perspective view of a chute configuration with a feeding chute in connection to an elevation device according to an embodiment of the present disclosure.
Figure 3B:
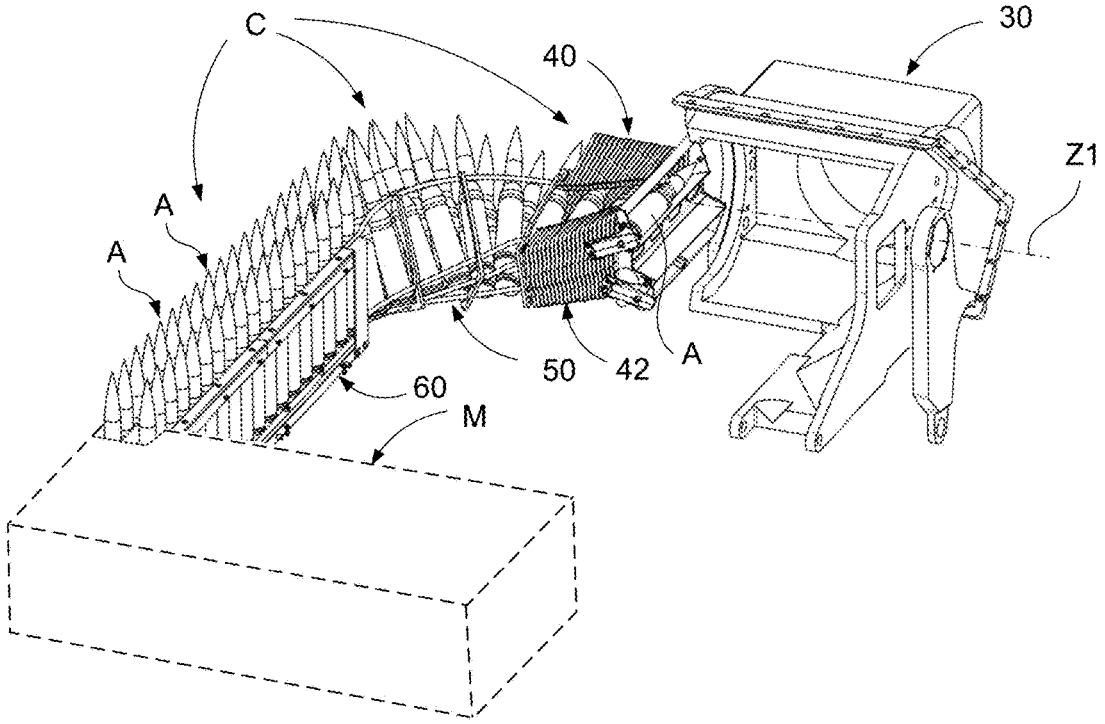
FIG. 3B schematically illustrates a perspective view of the chute configuration with ammunition and the elevation device in FIG. 3A, ammunition being guided in the chute configuration.
Figure 4A:
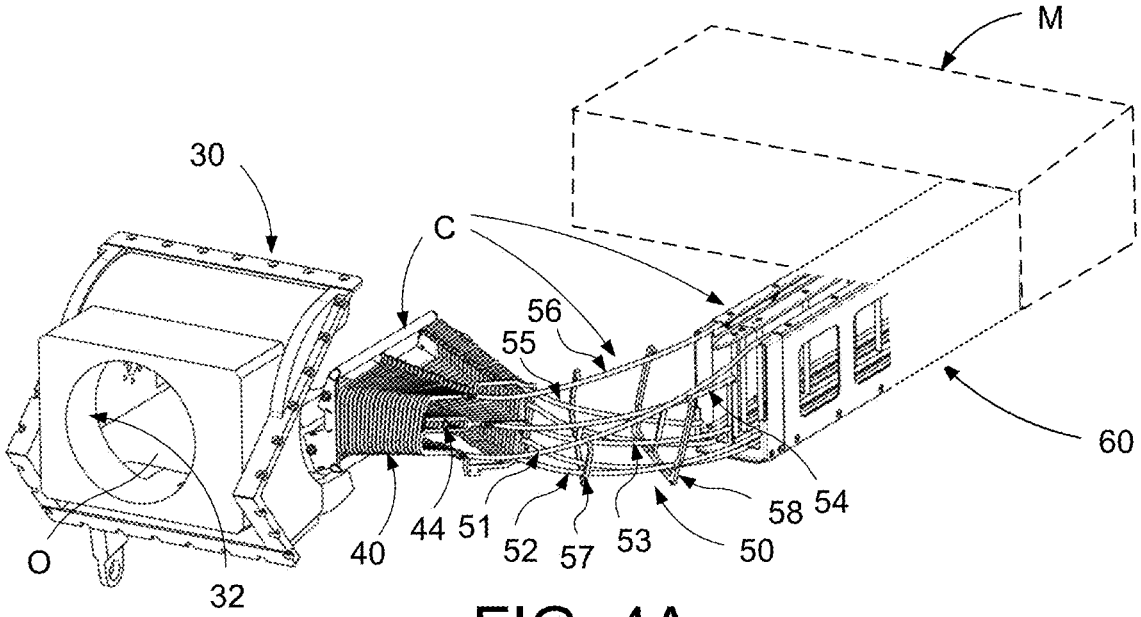
FIG. 4A schematically illustrates another perspective view of the chute configuration and the elevation device in FIG. 3A.
Figure 4B:
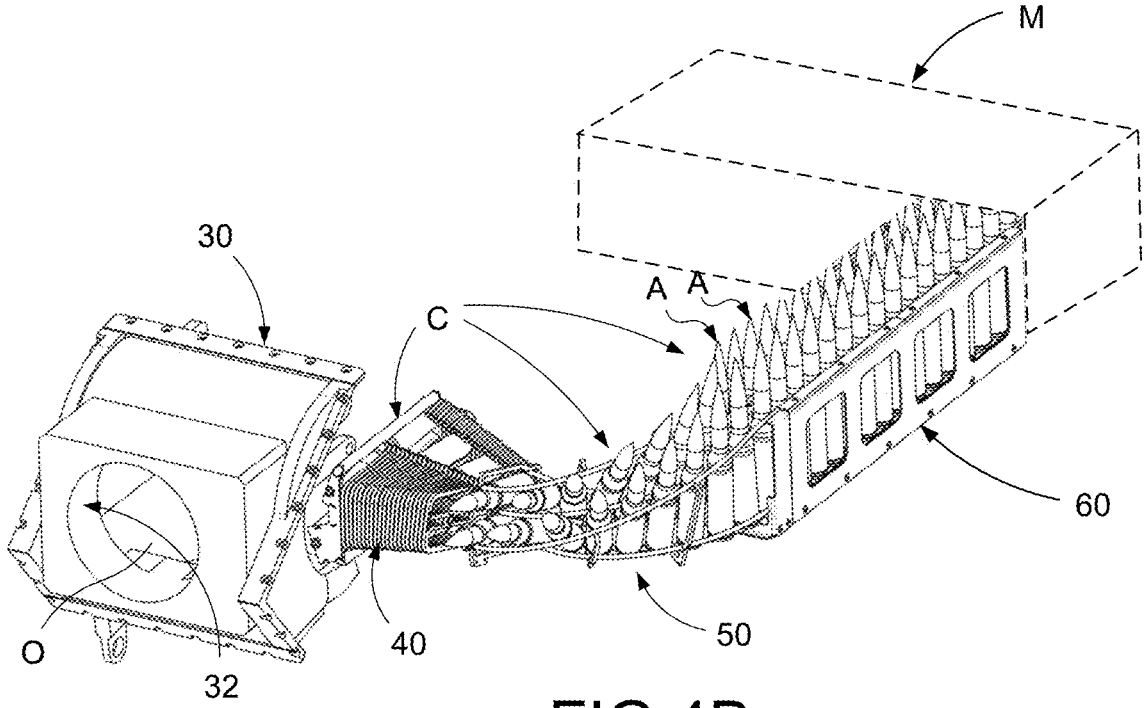
FIG. 4B schematically illustrates a perspective view of the chute configuration with ammunition and the elevation device in FIG. 4A, ammunition being guided in the chute configuration.

FIGS. 3A and 4A schematically illustrates different perspective views of a chute configuration C with a feeding chute 40 in connection to an elevation device 30 according to an embodiment of the present disclosure, and FIGS. 3B and 4B corresponding views with ammunition guided in the chute configuration. The chute configuration or parts of the chute configuration may be comprised in the arrangement for feeding ammunition to a weapon according to the present disclosure.

The chute configuration C comprises a feeding chute 40. The arrangement for feeding ammunition to a weapon according to the present disclosure comprises the feeding chute 40. The feeding chute 40 comprises a set of elements 42 assembled together in a stacked configuration. The individual elements of the set of elements 42 may also be denoted ribs or rib elements.

The set of elements 42 is arranged about a shaft 44, see FIG. 4A, configured to be concentrically arranged relative to the elevation axis Z1 of the elevation device 30, see e.g. FIGS. 3A-3B, so as to allow movement of individual elements of the set of elements 42 about said shaft 44 in connection to elevation movement of the weapon about the elevation axis Z1.

The feeding chute 40 is comprised in an arrangement for feeding ammunition to the weapon, the weapon not being shown in FIGS. 3A-3B, 4A-4B. The feeding chute 40 is configured to be connected at one end to the weapon. The end of the feeding chute configured to be connected to the weapon is faced towards the elevation device 30. The feeding chute 40 is arranged in connection to the elevation device 30 so that the shaft 44 is coaxial relative to the elevation axis Z1. The feeding chute 40 is described in more detail below with reference to FIGS. 5, 6, 7A-7B, 8 and 9A-9C.

The chute configuration C comprises a guiding chute 50, 60 for guiding the ammunition from an ammunition magazine M to the feeding chute 40. The ammunition magazine M is schematically illustrated in FIGS. 3A-3B and 4A-4B. The ammunition magazine may have any suitable configuration for housing ammunition.

The guiding chute 50, 60 comprises an intermediate chute 50 and an upright chute 60. The intermediate chute 50 is configured to connect the upright chute 60 with the feeding chute 40.

The ammunition magazine M may be configured to house the ammunition A in an upright position. The ammunition magazine M may have two channels for guiding the ammunition A. This in order to facilitate having to different types of ammunition.

The chute configuration C thus has two channels C1, C2 connecting to the channels of the ammunition magazine M, a first channel C1 connecting to a first channel of the magazine and a second channel connecting to a second channel of the magazine M.

The intermediate chute 50 has, according to this embodiment, a twisted configuration so as to guide the ammunition A from an essentially upright position in the magazine M and the upright chute 60 to an essentially lying position at the feeding chute 40.

The intermediate chute 50 comprises, according to this embodiment, a set of rods 51, 52, 53, 54, 55, 56 arranged to provide a twist and turn of the chute configuration C. The rods 51, 52, 53, 54, 55, 56 are supported by a pair of frame configurations 56, 57 arranged about rods, at a distance from each other.

The individual rounds of the ammunition A configured to be guided in the respective channel C1, C2 are linked together. Individual rounds of the ammunition A may also be denoted cartridges. The ammunition A configured to be provided in the magazine M and configured to be guided from the magazine via the chute configuration C to the weapon is in a linked-together state, where every single round is linked together.

The ammunition A may be in the form of an ammunition belt. The thus linked together ammunition A is configured to be moved by means of the weapon. Thus, the weapon comprises means for receiving ammunition and thus pulling the linked together ammunition A in connection to firing rounds. This may be obtained in any suitable manner by any suitable means, e.g. electrically and/or mechanically. The weapon may comprise any suitable ammunition mechanism, not shown.

The elevation device 30 may be configured to be connected to a bearing support member of a turret so as to facilitate said elevation movement by means of the elevation device 30.

The elevation device 30 is arranged to allow elevation movement of a weapon, e.g. a weapon 20 as described with reference to FIGS. 1 and 2. The elevation device 30 is arranged to allow elevation movement of a weapon about an elevation axis Z1.

The elevation device 30 is according to an aspect of the present disclosure configured to be attached to a turret, e.g. a turret 10 as described with reference to FIGS. 1 and 2, and thus configured to be rotated with the turret about the axis Y as illustrated in FIG. 1 and FIG. 2.

The elevation device 30 comprises a ring shaped support member 32 for supporting the weapon. The ring shaped support member 32 has an opening O through which the weapon, i.e. the gun barrel of the weapon, is intended to be arranged. The opening O of the ring shaped support member 32 has an extension corresponding to the extension of the gun barrel when mounted to the ring shaped support member 32. The elevation axis Z1 is arranged in connection to the ring shaped support member 32. The elevation axis Z1 is orthogonal to the axial extension of the opening O and hence the axial extension of the gun barrel of the weapon.

The elevation device 30 with the ring shaped support member 32 with the opening O may be configured to be journaled in bearings for facilitating rotation of the weapon cradle 30 about the axis Z1 for elevation of the gun barrel of the weapon when supported by the elevation device 30.

The elevation device 30 may thus be configured to be connected to the turret via such bearings so as to facilitate rotation of the elevation device 30 relative to the turret, i.e. about the axis Z1.

Figure 5:
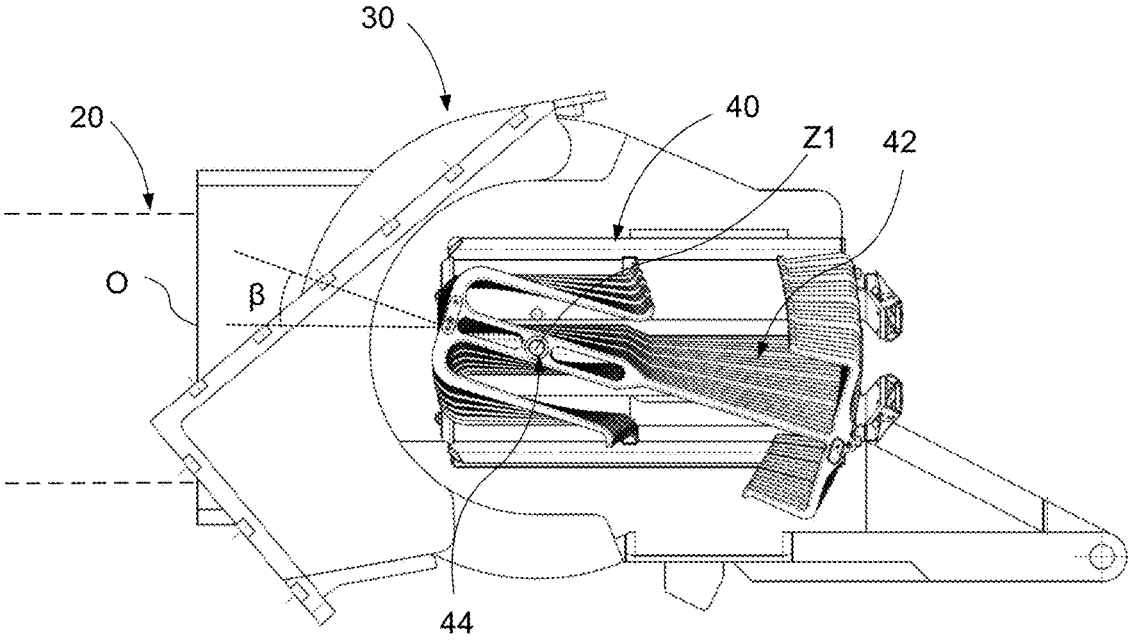
FIG. 5 schematically illustrates a side view of the feeding chute in connection to the elevation device according to an embodiment of the present disclosure.

FIG. 5 schematically illustrates a side view of the feeding chute 40 in connection to the elevation device 30 according to an embodiment of the present disclosure.

Here a portion of the weapon 20 is schematically illustrated extending from the opening O of the elevation device 30.

In FIG. 5, the weapon is in a horizontal position, wherein the end of the feeding chute 40 connected to the weapon 20 including the element closest to the weapon also has a corresponding horizontal arrangement. The element of the set of elements 42 of the feeding chute 40 configured to be closest to the weapon 20 is below, with reference to FIGS. 6, 7A-7B, 8 and 9A-9C denoted first end element.

The element of the set of elements 42 of the feeding chute 40 furthest away from the weapon has a certain inclination with an angle β between the maximum elevation angle and minimum elevation angle of the weapon, see also FIG. 2. The element of the set of elements 42 of the feeding chute 40 configured to be furthest away from the weapon 20 is below, with reference to FIGS. 6, 7A-7B, 8 and 9A-9C denoted second end element.

Figure 6:
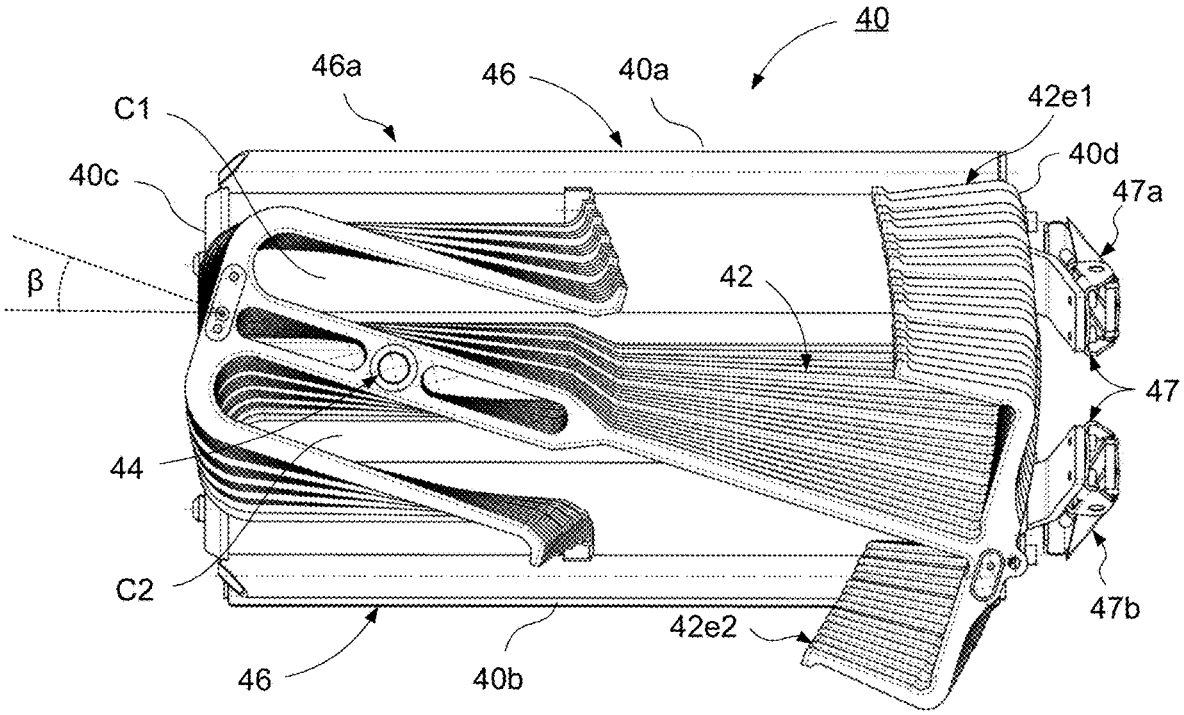
FIG. 6 schematically illustrates a side view of the feeding chute in FIG. 5.
Figure 7A:
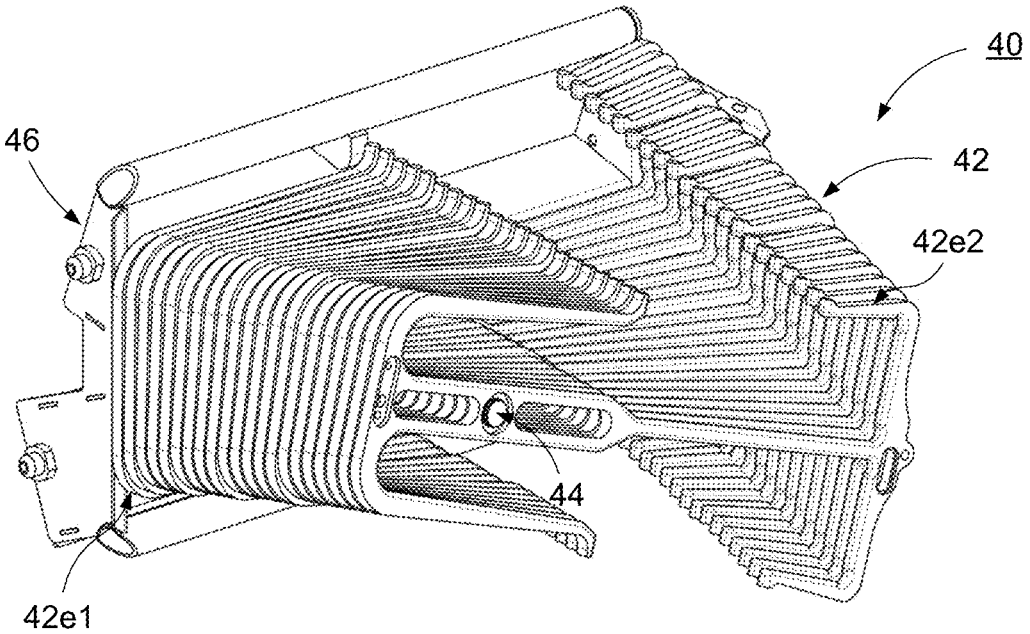
FIG. 7A schematically illustrates a perspective view of the feeding chute in FIG. 5.
Figure 7B:
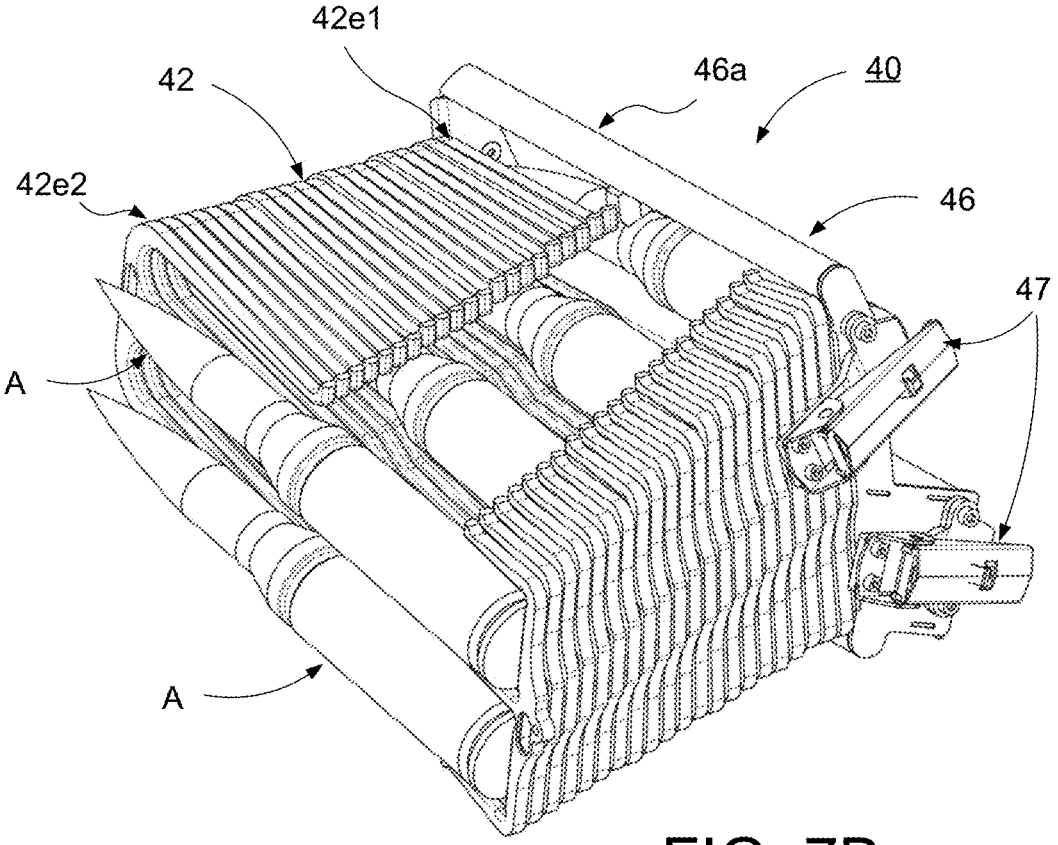
FIG. 7B schematically illustrates a perspective view of the feeding chute in FIG. 7A, ammunition being fed through the feeding chute.

FIG. 6 schematically illustrates a side view of the feeding chute in FIG. 5 according to an embodiment of the present disclosure, FIG. 7A schematically illustrates a perspective view of the feeding chute in FIGS. 5 and 6; FIG. 7B schematically illustrates a perspective view of the feeding chute in FIG. 7A, ammunition being fed through the feeding chute.

Figure 8:
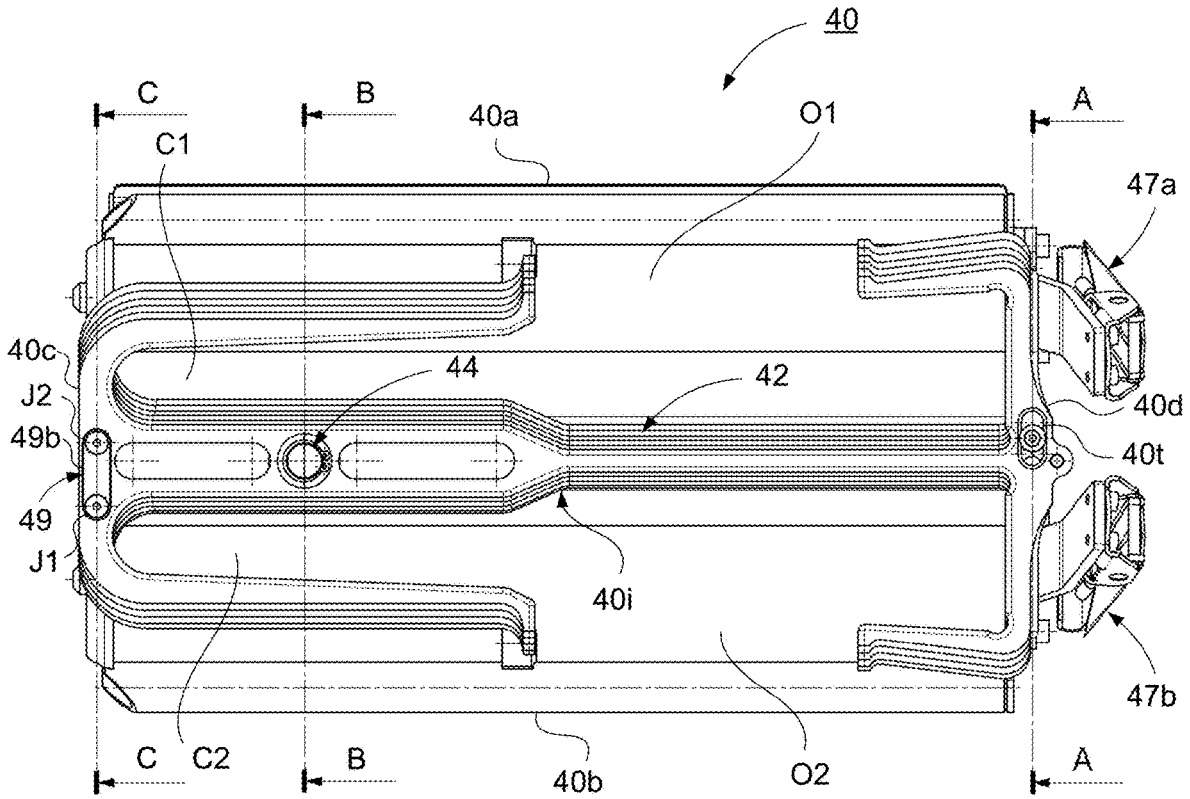
FIG. 8 schematically illustrates a side view of the feeding chute in FIG. 5.
Figure 9A:
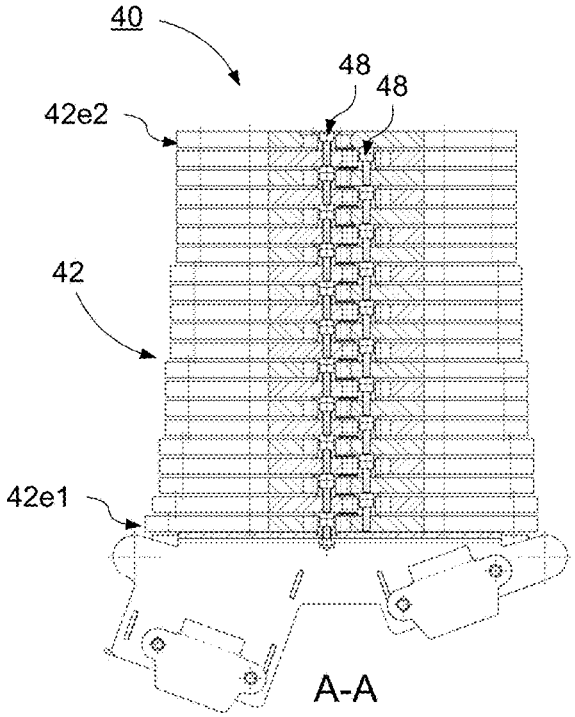
FIG. 9A schematically illustrates a cross section A-A of the side view of the feeding chute in FIG. 8.
Figure 9B:
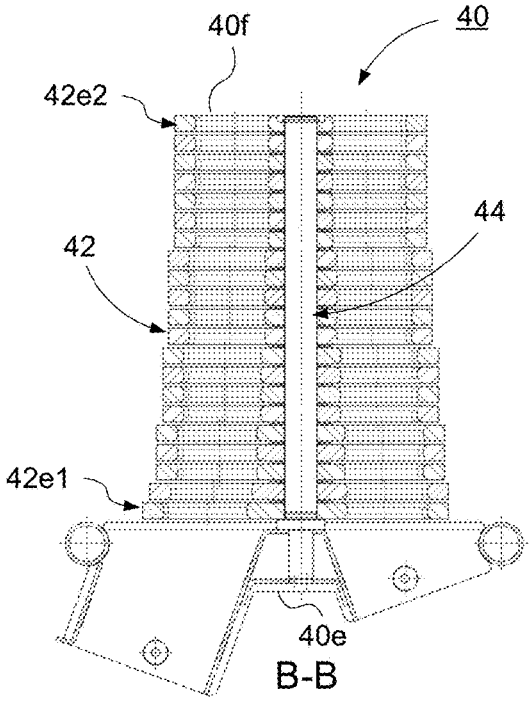
FIG. 9B schematically illustrates a cross section B-B of the side view of the feeding chute in FIG. 8.
Figure 9C:
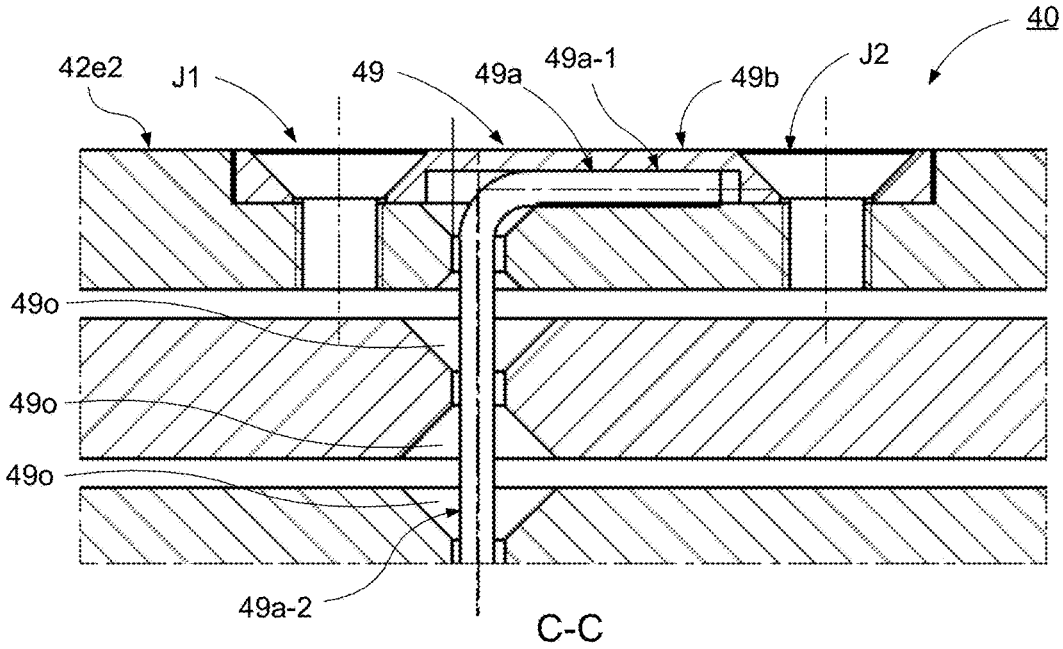
FIG. 9C schematically illustrates a cross section C-C of the side view of the feeding chute in FIG. 8.

FIG. 8 schematically illustrates a side view of the feeding chute in FIG. 5. FIG. 9A schematically illustrates a cross section A-A of the side view of the feeding chute in FIG. 8; FIG. 9B schematically illustrates a cross section B-B of the side view of the feeding chute in FIG. 8; and FIG. 9C schematically illustrates a cross section C-C of the side view of the feeding chute in FIG. 8.

The feeding chute 40 has a first side 40*a* and an opposite second side 40*b*, see FIGS. 6 and 8. The feeding chute 40 has a third side 40*c* and an opposite fourth side 40*d*, see FIGS. 6 and 8. The first side 40*a* and opposite second side 40*b* are essentially perpendicular to the third side 40*c* and an opposite fourth side 40*d*, providing a rectangular configuration. The feeding chute has a connection side 40*e* for connection to the weapon and an opposite receiving side 40*f*, see FIG. 9B. The connection side 40*e* and receiving side 40*f* are surrounded by the first side 40*a*, second side 40*b*, third side 40*c* and fourth side 40*d*, forming the feeding chute 40.

For the feeding chute 40, when connected to a weapon on a vehicle being in an essentially horizontal position, the first longitudinal side 40*a* is the upper side 40*a*, the opposite second longitudinal side 40*b* is the lower side 40*b*, the third side 40*c* is the front side 40*c*, i.e. directed in the direction of the gun barrel of the weapon, i.e. shooting direction, and the fourth side 40*d* is the rear side 40*d*. The sides 40*a*, 40*b*, 40*c*, 40*d*, 40*e* and 40*f* will be referred to as if the feeding chute 40 is connected to a weapon on a vehicle, e.g. a vehicle V according to FIG. 1.

The feeding chute 40 comprises said set of elements 42 assembled together in a stacked configuration. The set of elements 42 is arranged about a shaft 44 configured to be concentrically arranged relative to the elevation axis so as to allow movement of individual elements of the set of elements 42 about said shaft 44 in connection to elevation movement of the weapon 20 about the elevation axis Z1, see e.g. FIG. 5.

The individual elements of the feeding chute 40, when moved, are only pivoted about the shaft 44, i.e. only in a plane essentially orthogonal to the elevation axis. The individual elements are tightly stacked together, which is facilitated by the rotation of the individual elements of the set of element 42 in only one plane.

According to an aspect of the present disclosure, the feeding chute 40 comprises an upper channel C1 for feeding ammunition and a lower channel C2 for feeding ammunition. The upper channel C1 may thus constitute a portion of the first channel C1 of the chute configuration C described with reference to e.g. FIG. 3A. The lower channel C2 may thus constitute a portion of the second channel C2 of the chute configuration C described with reference to e.g. FIG. 3A.

According to an aspect of the present disclosure, the shaft 44 is arranged between the upper and lower channel. According to an aspect of the present disclosure, the feeding chute 40 comprises an intermediate portion 40*i* configured to run between the upper channel C1 and lower channel C2. The intermediate portion 40*i* is configured to divide the feeding chute 40 into two channels C1, C2. The intermediate portion 40*i* thus has an extension corresponding to the extension of the channels C1, C2. The shaft 44 is arranged to run through the intermediate portion 40*i*.

The upper channel C1 and the lower channel C2 has a shape essentially corresponding to the shape of the ammunition. The upper channel C1 and the lower channel C2 thus is narrower in connection to the short side 40*c*, i.e. the side 40*c* directed in the direction of the gun barrel of the weapon, see FIG. 5 and FIG. 6.

According to an aspect of the present disclosure, the feeding chute 40 comprises an upper opening O1 arranged at the upper side 40*a* so as to facilitate manual introduction into the weapon of an individual round of the linked-together ammunition from the upper channel C1, see FIG. 8.

According to an aspect of the present disclosure, the feeding chute 40 comprises lower opening O2 arranged at the lower side 40*b* so as to facilitate manual introduction into the weapon of an individual round of the linked-together ammunition from the lower channel C2, see FIG. 8.

The feeding chute according to the present disclosure may alternatively be configured with a single channel. The feeding chute according to the present disclosure may be configured with any suitable number of channels.

The individual elements of the feeding chute 40 are, according to an aspect of the present disclosure, formed in one piece.

The individual elements of the feeding chute 40 have a plate configuration. The individual elements of the feeding chute 40 may be denoted plate elements or plate members.

The individual elements of the feeding chute 40 have an upper side forming the upper side 40*a* of the feeding chute 40 when stacked together with the rest of the set of elements 42.

The individual elements of the feeding chute 40 have a lower side forming the lower side 40*b* of the feeding chute 40 when stacked together with the rest of the set of elements 42.

The individual elements of the feeding chute 40 have a front side forming the front side 40*c* of the feeding chute 40 when stacked together with the rest of the set of elements 42.

The individual elements of the feeding chute 40 have a rear side forming the rear side 40*d* of the feeding chute 40 when stacked together with the rest of the set of elements 42.

According to an aspect of the present disclosure, the feeding chute 40, in connection to said connection end 40*e* of the feeding chute 40, comprises a support frame 46 for supporting the set of elements 42 having an upper frame portion 46*a* arranged on the upper side 40*a* and a lower frame portion 46*b* arranged on the lower side 40*b*. The support frame 46 is configured to be fixedly attached to the weapon.

According to an aspect of the present disclosure, the feeding chute 40, in connection to said connection end 40*e* of the feeding chute 40, comprises a fastening arrangement 47 for attaching the feeding chute 40 to the weapon.

The fastening arrangement 47 comprises a pair of locking members 47*a*, 47*b* for lockingly attach the feeding chute 40 to the weapon. The fastening arrangement 47 is attached to the support frame 46. The support frame 46 is here configured to be fixedly attached to the weapon by means of the fastening arrangement 47.

The feeding chute 40 is configured to be attached to the weapon by means of the fastening arrangement 47 so that the element closest to the weapon, below denoted first end element 42*e*1, is rotated about the shaft 44 corresponding to the elevation movement of the weapon. The feeding chute 40 may be attached to the weapon by means of any suitable fastening arrangement.

According to an aspect of the present disclosure, the feeding chute 40 comprises a first end element 42*e*1 configured to be closest to the weapon. The first end element 42*e*1 is arranged at the connection side 40*e*, see FIG. 9B.

The first end element 42*e*1 is configured to be pivoted about the shaft 44 corresponding to the elevation movement of the weapon about the elevation axis. The first end element 42*e*1 is configured to fixedly attached to the support frame 46.

According to an aspect of the present disclosure, the feeding chute 40 comprises a second end element 42*e*2 configured to be furthest away from the weapon. The second end element 42*e*2 is arranged at the receiving side 40*f* opposite to the connection side 40*e*.

The second end element 42*e*2 is configured to be essentially fixed so that it is at the same position independently of elevation angle of the weapon thus connected to the feeding chute 40. The second end element 42*e*2 is configured to be essentially fixed to the guiding chute, see e.g. FIGS. 3A, 4A, so that feeding of ammunition from the guiding chute may be easily obtained independent of elevation angle of the weapon. Thus, the second end element 42*e*2 is configured to be essentially fixed to the guiding chute so that the ammunition may be introduced to the feeding chute 40 via the connected guiding chute.

According to an aspect of the present disclosure, the elements of the set of elements 42 between the first end element 42*e*1 and the second end element 42*e*2 are gradually mutually displaceable. The individual elements are according to an embodiment configured to be mutually displaced based on elevation angle so as to allow ammunition to be fed through the channels C1, C2 of the feeding chute 40.

According to an aspect of the present disclosure, the individual elements movable about said shaft 44 are configured to be rotated about the shaft a certain angle relative to an adjacent element so as to allow feeding of ammunition through the feeding chute 40 at all elevation angles of the elevation device.

The rotation of the individual elements about said shaft 44 are, according to an aspect of the present disclosure, set to a maximum rotation angle so that the displacement relative to adjacent elements is such that ammunition may be fed through the feeding chute 40 without interruption and thus easily and efficiently obtained.

The number of elements of the set of elements 42 are chosen such that, with such a maximum rotation angle of individual elements, the feeding chute 40 with the set of elements 42 movably arranged about the shaft 44 will facilitate feeding of ammunition through the feeding chute 40, i.e. through the channels C1, C2 of the feeding chute 40, at all elevation angles of the weapon.

The feeding chute 40 comprises a track member 40*t* arranged in connection to the rear side 40*d* and configured to run through the set of elements 42 so as to limit the rotation of the individual elements about the shaft 44. The track member 40*t* is arranged in connection to the intermediate portion 40*i* in connection to the rear side 40*d*. The track member 40*t* may be comprised in a rotation limit arrangement configured to limit rotation of the individual elements about the shaft 44.

The track member 40*t* is running in a direction essentially orthogonal to the extension of the shaft 44 and essentially orthogonal to the extension of the intermediate portion 40*i*. The track member 40*t* is running in a direction essentially orthogonal to the extension of the shaft 44 and essentially orthogonal to the extension of the intermediate portion 40*i* so as to allow a certain rotation of the respective element of the set of elements 42 about the shaft 44. The track member 40*t* is running in a direction essentially orthogonal to the extension of the shaft 44 and essentially orthogonal to the extension of the intermediate portion 40*i* so as to provide a limit of the rotation of the respective element of the set of elements 42 about the shaft 44.

The arrangement for feeding ammunition to a weapon according to the present disclosure may comprise such a track member arranged in connection to the rear side, or alternatively the opposite front side, of the feeding chute 40 configured to run through the set of elements 42 so as to limit the rotation of the individual elements about the shaft.

The individual elements of the feeding chute 40 comprise a track member, i.e. a track, arranged in connection to the rear side of the individual elements, forming the track member 40*t* of the feeding chute 40 when stacked together with the rest of the set of elements 42. The track member 40*t* thus run through the respective element in a direction essentially parallel to the extension of the axial extension of the shaft 44. The respective track member, i.e. respective track, arranged in connection to the rear side of individual elements and running through individual elements is thus running in a direction essentially orthogonal to the extension of the shaft 44 so as to provide a limit of the rotation of the respective element of the set of elements 42 about the shaft 44. The track member, i.e. track, arranged in connection to the rear side of individual elements is thus running in a direction essentially orthogonal to the extension of the shaft 44 and essentially orthogonal to the extension of the intermediate portion 40*i* so as to provide a limit of the rotation of the respective element of the set of elements 42 about the shaft 44. The track member, i.e. track, arranged in connection to the rear side of the individual elements may be comprised in said rotation limit arrangement configured to limit rotation of the individual elements about the shaft 44.

The individual elements of the feeding chute 40 are linked together by means of distance members 48 arranged in connection to the track member 40*t*. The distance members 48 are configured to hold the individual elements together in the axial direction, i.e. direction of the shaft 44, and limit the relative movement of the elements by means of the track member 40. The distance members 48 may be comprised in said rotation limit arrangement configured to limit rotation of the individual elements about the shaft 44.

Individual distance members 48 of said set of distance members 48 are according to an aspect of the present disclosure configured to connect track member, i.e. track, of individual element and adjacent element so as to limit the rotation of the individual elements about the shaft 44 of the feeding chute 40, see FIG. 9A.

According to an aspect of the present disclosure, when the respective element of the set of elements are arranged on essentially the same level, i.e. when there is essentially no mutual displacement of said individual elements, the track, i.e. track member, of the respective individual element is displaced relative to the adjacent element in an alternating manner, see FIG. 9A. Thus, the track, i.e. track member, of the respective individual element is alternatingly displaced relative to adjacent elements so as to facilitate connection of adjacent elements by means of an individual distance member 48 such that the individual distance member 48 is fixedly connected to one of the elements and movably connected to the track of the adjacent element so as to allow limited mutual displacement of that element relative to the element to which the distance member is fixed.

For the individual element to which that distance member 48 is fixed, another distance member 48 is movably connected to the track of that individual element, the other distance member 48 being fixedly connected to the next adjacent element and so on, as is illustrated in FIG. 9A.

Said set of distance members 48 have according to an aspect of the present disclosure a longitudinal extension. Said set of distance members 48 have according to an aspect of the present disclosure a joint member configuration. Said set of distance members 48 have according to an aspect of the present disclosure a cylindrical configuration. Said set of distance members 48 have according to an aspect of the present disclosure a longitudinal extension so as to reach through two adjacent elements of the set of elements 42. Said set of distance members 48 are according to an aspect of the present disclosure configured to be movable along a track member, i.e. track, of an individual element in the longitudinal extension of said track member.

According to an embodiment the arrangement feeding ammunition to a weapon according to the present disclosure may comprise distance members arranged in connection to the track member and configured to hold the individual elements together in the axial direction, i.e. direction of the shaft, and limit the relative movement of the elements by means of the track member.

The feeding chute 40 comprises an element displacement control arrangement 49 for controlling mutual displacement of the individual elements of the set of element 42 of the feeding chute 40, see FIGS. 8 and 9C. The element displacement control arrangement 49 is arranged in connection to the front side 40*c*. The element displacement control arrangement 49 is arranged in connection to the intermediate portion 40*i* in connection to the front side 40*c*.

The element displacement control arrangement 49 comprises a spring member 49*a*. The spring member 49*a* is configured to be fixed to the second end element 42*e*2, shown in FIG. 9C. The element displacement control arrangement 49 comprises a fixation member 49*b* for fixation of the spring member 49*a*. The fixation member 49*b* is attached to the end of the second end element 42*e*2 by means of screw joints J1, J2, here a pair of screw joints J1, J2. The fixation member 49*b* has an extension running in a direction essentially orthogonal to the axial extension of the shaft 44 and essentially orthogonal to the extension of the intermediate portion 40*i*.

The spring member 49*a* comprises a fixation portion 49*a*-1 configured to be fixated by means of the fixation member 49*b*. The fixation portion 49*a*-1 of the spring member 49*a* has an extension corresponding to the extension of the fixation member 49*b*. The fixation portion 49*a*-1 of the spring member 49*a* is arranged between the screw joints J1, J2.

The spring member 49*a* comprises a spring rod 49*a*-2 configured to run through the individual elements from the second end element 42*e*2, where the fixation portion 49*a*-1 of the spring member 49*a* is fixated to and through the first end element 42*e*1, not shown in FIG. 9C. The spring rod 49*a*-2 is configured to run through openings 49*o* of the individual elements.

The spring member 49*a* is configured to control mutual displacement of the individual elements of the set of element 42 of the feeding chute 40 in connection to elevation movement of the weapon. The spring rod 49*a*-2 of the spring member 49*a* is configured to control mutual displacement of the individual elements of the set of element 42 of the feeding chute 40 in connection to elevation movement of the weapon and thus movement of the individual elements about the shaft 44.

The spring rod 49*a*-2 of the spring member 49*a* is configured to bend in connection to elevation movement of the weapon and thus rotation of the individual elements about the shaft 44 so as to control mutual displacement of the individual elements of the set of elements 42 so that the displacement of individual elements relative to adjacent elements is essentially the same.

The openings 49*o* of the individual elements of the set of elements 42 are configured to provide space for bending of the spring rod 49*a*-2 in connection to rotation of the individual elements about the shaft 44. The spring rod 49*a*-2 is configured to run through the individual elements comprising the first end element 42*e*1, not shown in FIG. 9C, so as to allow axial movement in connection to bending of the spring rod 49*a*-2.

According to an embodiment the arrangement for feeding ammunition to a weapon according to the present disclosure may comprise such an element displacement control arrangement for controlling mutual displacement of the individual elements of the set of element of the feeding chute arranged in connection to a front side, i.e. the side facing in the firing direction of the weapon, or an opposite rear side of the feeding chute. The element displacement control arrangement is configured to be arranged on the opposite side relative to the arrangement of the track member.

According to an embodiment of the arrangement, the element displacement control arrangement may comprise a spring member configured to be fixed to an end element and comprising a spring rod configured to run through the individual elements from one end element to an opposite end element and being configured to control mutual displacement of the individual elements of the set of element of the feeding chute in connection to elevation movement of the weapon.

The individual elements of the feeding chute 40 are configured to allow making the element integral with at least one other element so as to form the feeding chute 40.

The individual elements of the feeding chute 40 comprise an opening for receiving the shaft 44 arranged in the intermediate portion 40*i*, forming the surrounding of the shaft 44 for the feeding chute 40 when stacked together with the rest of the set of elements 42.

According to an aspect of the present disclosure, the second end element 42*e*2 furthest away from the weapon is configured to have an angle β within a range between the maximum elevation angle and minimum elevation angle of the weapon, see FIG. 5. The second end element 42*e*2 furthest away from the weapon is configured to have an angle β so that the number of elements of the set of elements 42 of the feeding chute 40 may be minimized and thus optimizing the compactness of the feeding chute 40.

According to an aspect of the present disclosure, the second end element 42*e*2 furthest away from the weapon is configured to have an angle β so that only essentially half of the elevation angle is required for the feeding chute for elevation corresponding to rising of the weapon to the highest elevation angle and lowering to the lowest elevation angle, see also FIG. 2. Elevation of the weapon, i.e. gun barrel of the weapon, upwardly usually corresponds to an elevation angle α1 substantially greater than the elevation angle α2 for lowering the weapon 20, see FIG. 2.

According to an aspect of the present disclosure, the second end element 42*e*2 furthest away from the weapon, for a weapon in a horizontal position, given that the vehicle is in a horizontal position, is configured to have an angle β so that the second end element has a certain upward direction in the forward direction of gun barrel of the weapon.

According to an embodiment of the arrangement, the set of elements are pivotably journalled about said shaft. Hereby easy and efficient rotation of individual element about the shaft is facilitated.

Figure 10A:
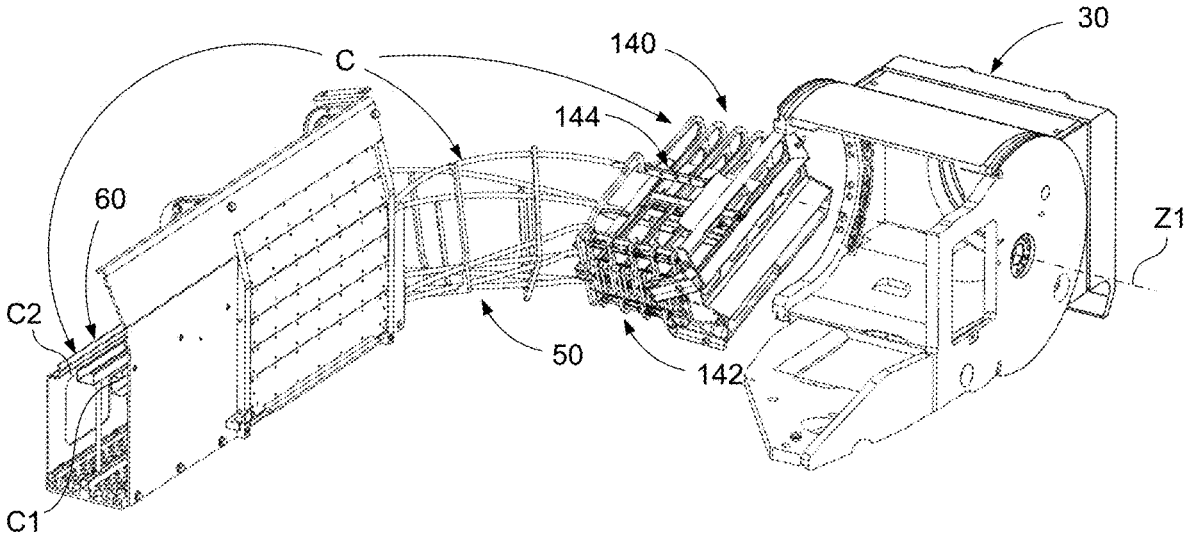
FIG. 10A schematically illustrates a perspective view of a chute configuration with a feeding chute in connection to an elevation device according to an embodiment of the present disclosure.
Figure 10B:
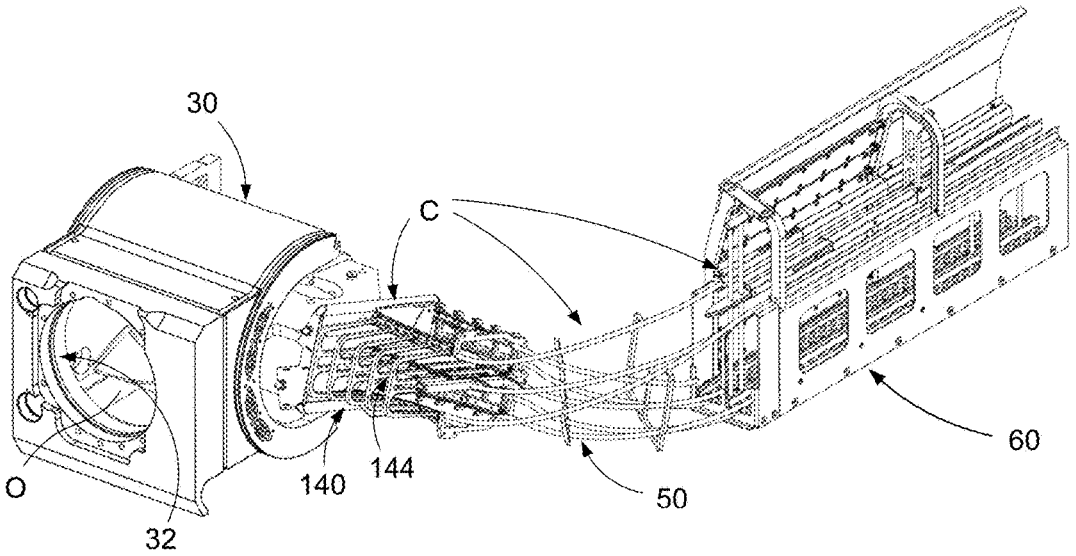
FIG. 10B schematically illustrates another perspective view of the chute configuration and the elevation device in FIG. 10A.

FIGS. 10A and 10B schematically illustrates different perspective views of a chute configuration C with a feeding chute 140 in connection to an elevation device 30 according to an embodiment of the present disclosure. The chute configuration or parts of the chute configuration may be comprised in the arrangement for feeding ammunition to a weapon according to the present disclosure.

The chute configuration C comprises a feeding chute 140. The arrangement for feeding ammunition to a weapon according to the present disclosure comprises the feeding chute 140. The feeding chute 140 comprises a set of elements 142 assembled together in a stacked configuration. The individual elements of the set of elements 142 may also be denoted ribs or rib elements.

The set of elements 142 is arranged about a shaft 144, see FIG. 10B, configured to be concentrically arranged relative to the elevation axis Z1 of the elevation device 30, so as to allow movement of individual elements of the set of elements 142 about said shaft 144 in connection to elevation movement of the weapon about the elevation axis Z1.

The feeding chute 140 is comprised in an arrangement for feeding ammunition to the weapon, the weapon not being shown in FIGS. 10A-10B. The feeding chute 140 is configured to be connected at one end to the weapon. The end of the feeding chute 140 configured to be connected to the weapon is faced towards the elevation device 30. The feeding chute 140 is arranged in connection to the elevation device 30 so that the shaft 144 is coaxial relative to the elevation axis Z1. The feeding chute 140 is described in more detail below with reference to FIGS. 11A-11B, 12A-12B, 13A-13B, 14A-14B, 15, 16 and 17A-17B.

The chute configuration C comprises a guiding chute 50, 60 for guiding the ammunition from an ammunition magazine to the feeding chute 40. The ammunition magazine may have any suitable configuration for housing ammunition.

The guiding chute 50, 60 may be a guiding chute essentially corresponding to the guiding chute 50, 60 in FIGS. 3A-3B, 4A-4B. The guiding chute 50, 60 comprises an intermediate chute 50 and an upright chute 60. The intermediate chute 50 is configured to connect the upright chute 60 with the feeding chute 40.

Figure 13A:
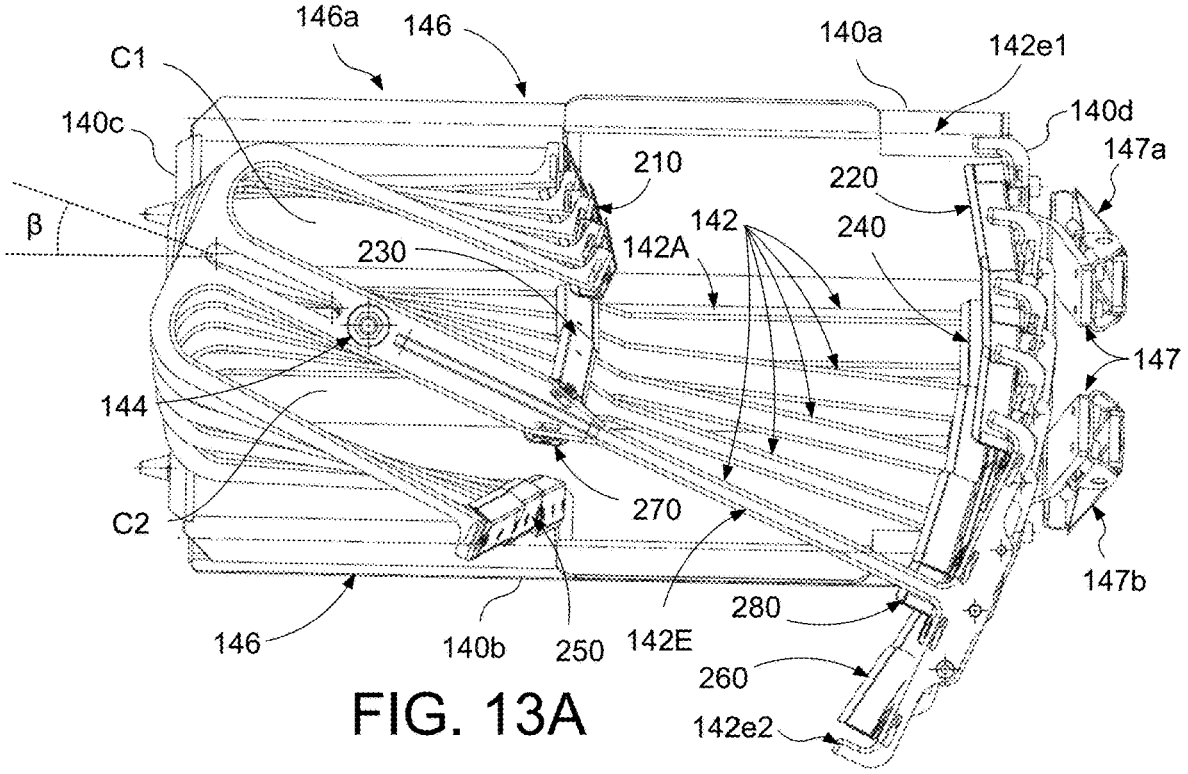
FIG. 13A schematically illustrates a side view of the feeding chute in FIG. 11A.
Figure 13B:
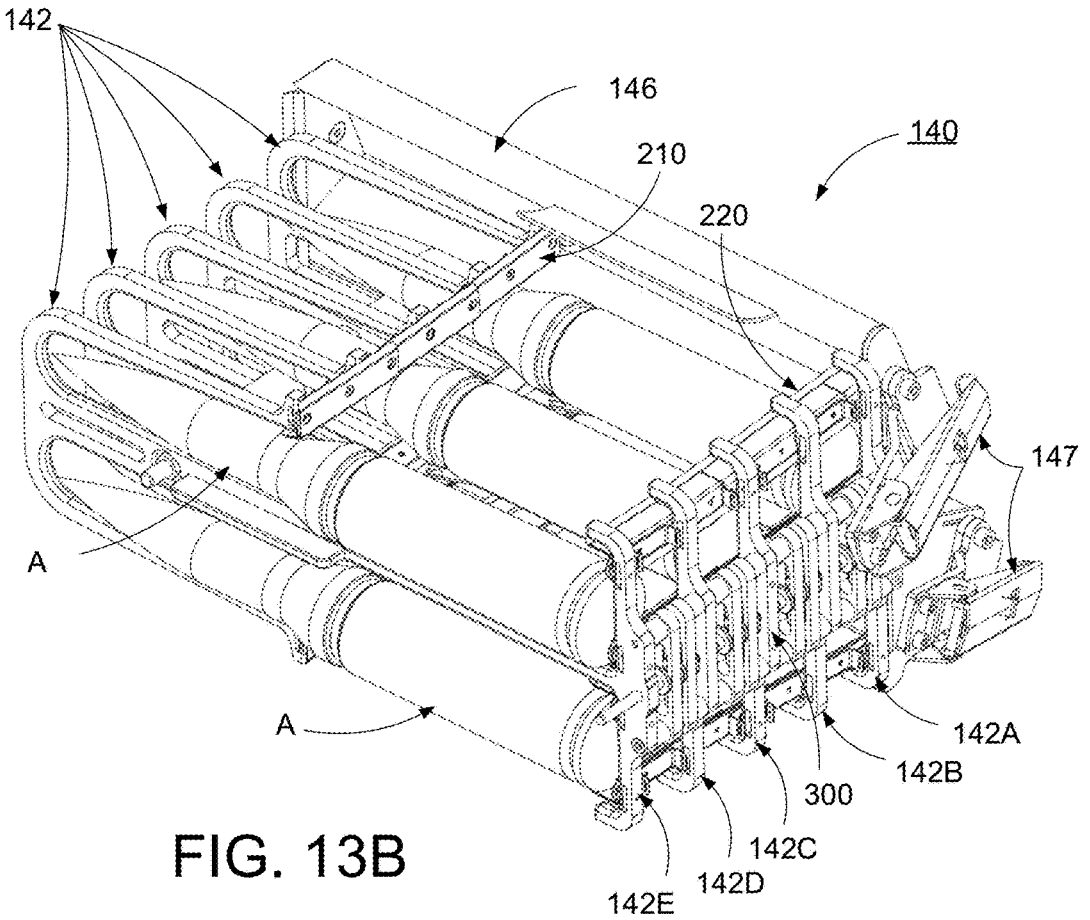
FIG. 13B schematically illustrates a perspective view of the feeding chute in FIG. 11A, ammunition being fed through the feeding chute.
Figure 14A:
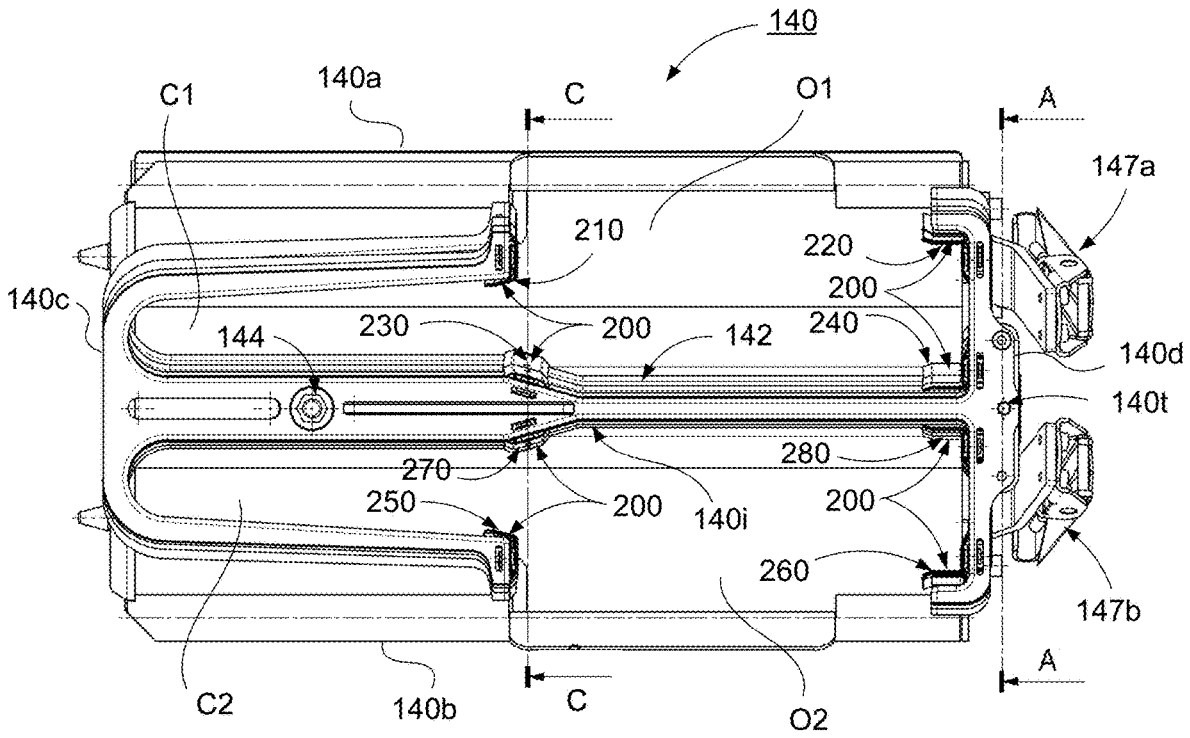
FIG. 14A schematically illustrates a side view of the feeding chute in FIG. 11A.
Figure 14B:
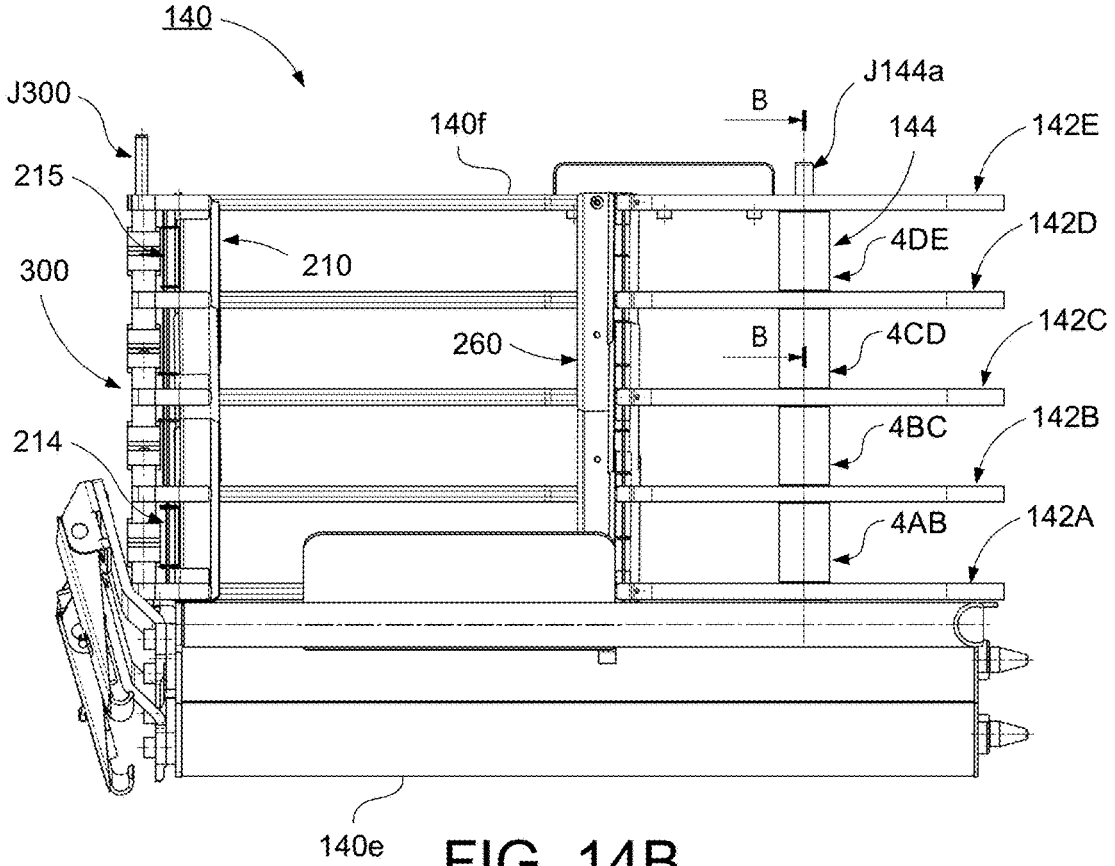
FIG. 14B schematically illustrates another side view of the feeding chute in FIG. 11A.

FIGS. 11A-11B, 12A-12B schematically illustrates different perspective views of a feeding chute 140 according to an embodiment of the present disclosure; FIGS. 13A, 14A-14B schematically illustrates different side views of the feeding chute 140 in FIG. 11A; and FIG. 13B schematically illustrates a perspective view of the feeding chute 140 in FIG. 11A, ammunition being fed through the feeding chute 140.

Figure 15:
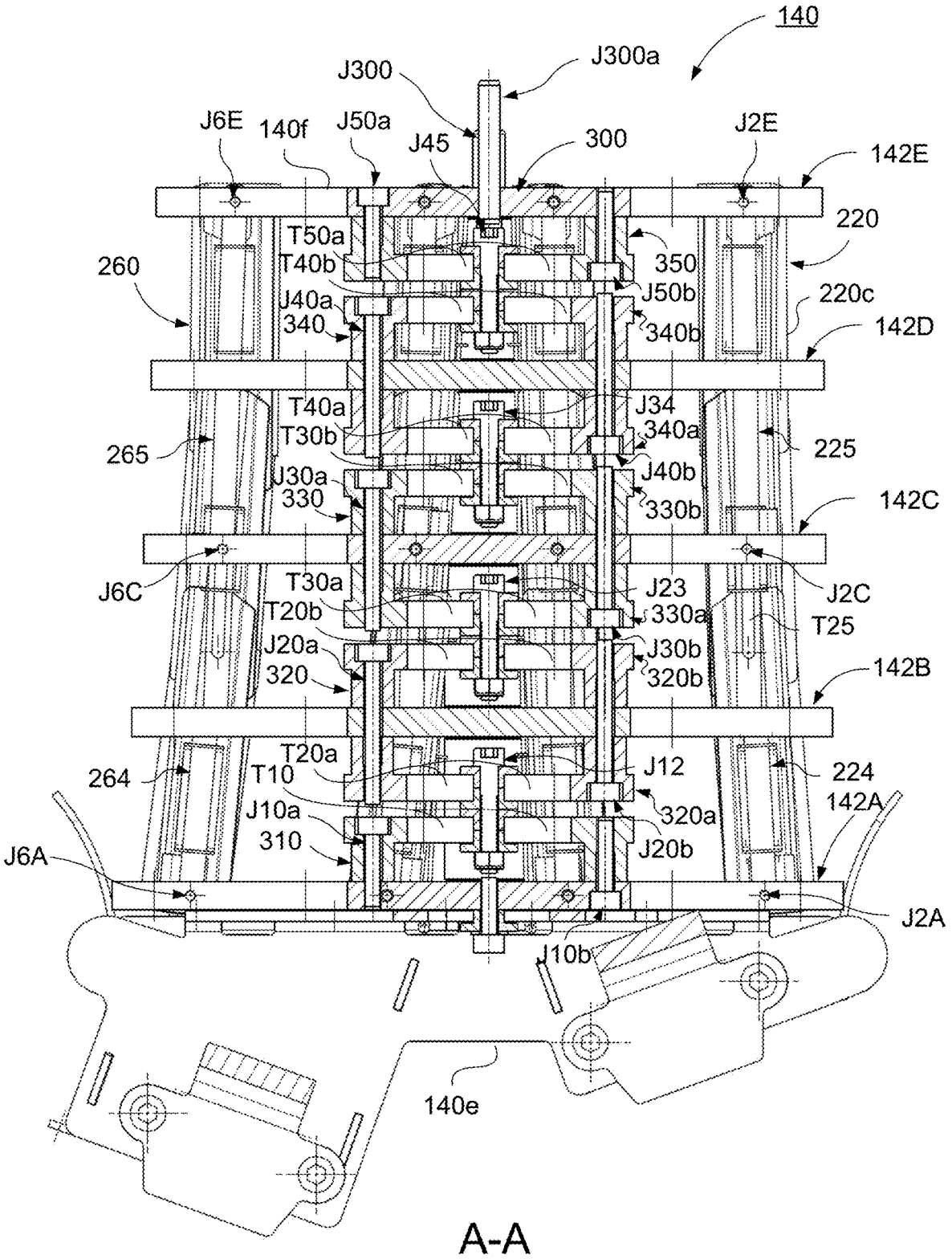
FIG. 15 schematically illustrates a cross section A-A of the side view of the feeding chute in FIG. 14A.
Figure 16:
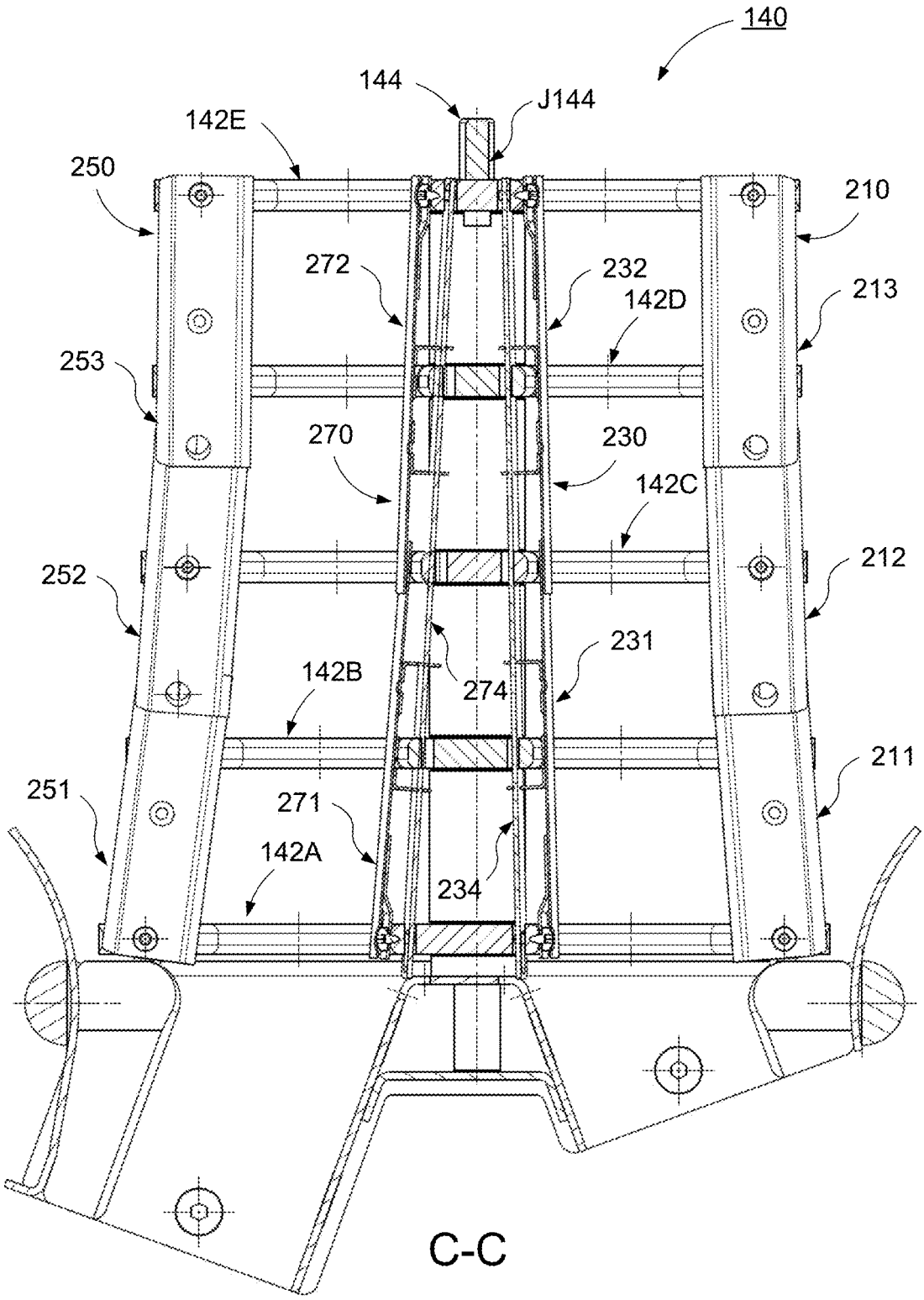
FIG. 16 schematically illustrates a cross section C-C of the side view of the feeding chute in FIG. 14A.
Figure 17A:
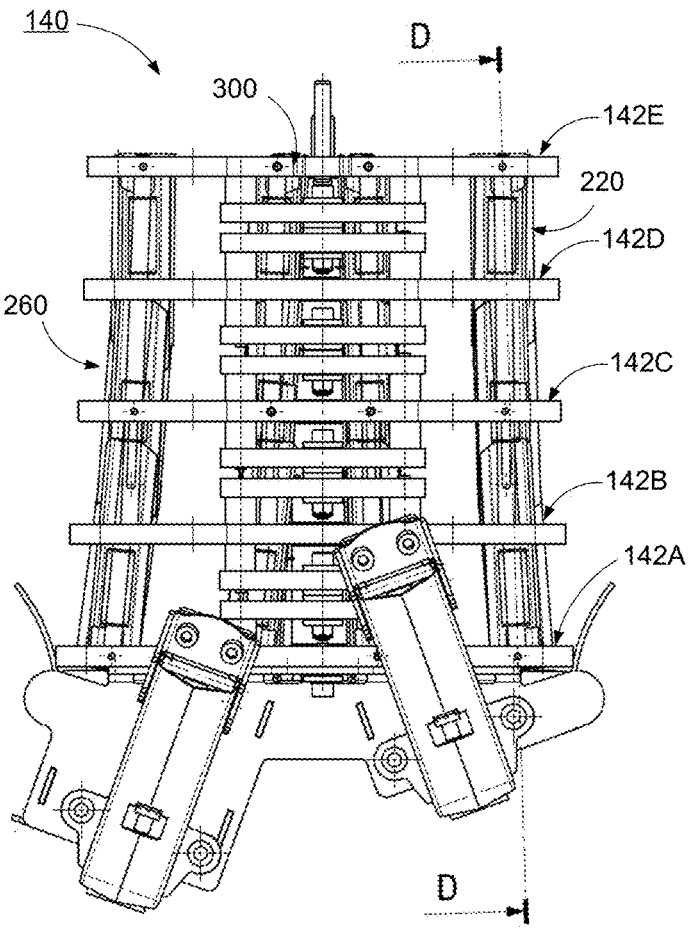
FIG. 17A schematically illustrates another side view of the feeding chute in FIG. 11*a;*
Figure 18:
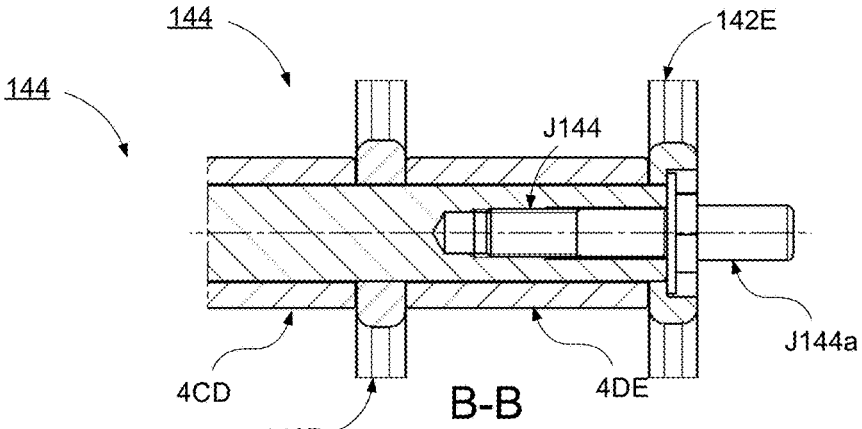
Figure 17B:
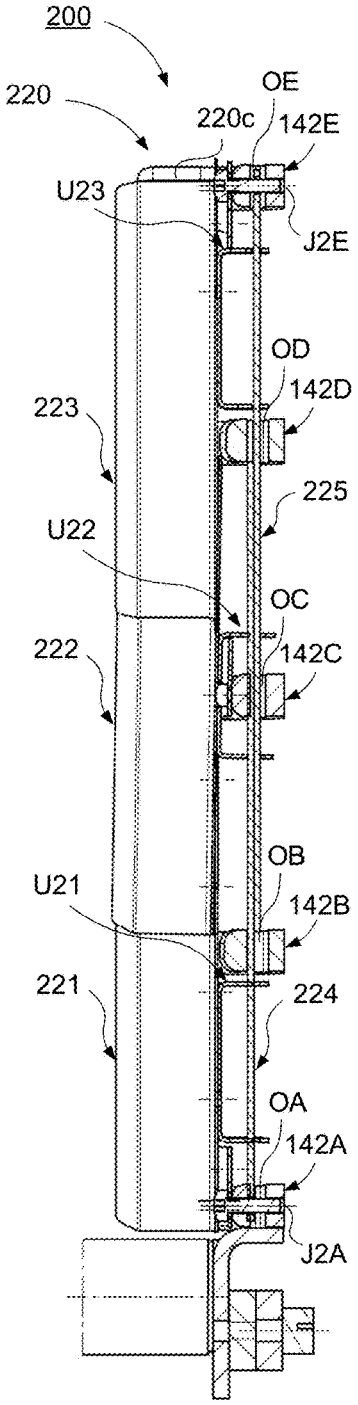
FIG. 17B schematically illustrates a cross section D-D of the side view of the feeding chute in FIG. 17A; and, FIG. 18 schematically illustrates a cross section B-B of the side view of the feeding chute in FIG. 14B.

FIG. 15 schematically illustrates a cross section A-A of the side view of the feeding chute 140 in FIG. 14A; FIG. 16 schematically illustrates a cross section C-C of the side view of the feeding chute 140 in FIG. 14A; FIG. 17A schematically illustrates another side view of the feeding chute 140 in FIG. 11A; FIG. 17B schematically illustrates a cross section D-D of the side view of the feeding chute 140 in FIG. 17A; and, FIG. 18 schematically illustrates a cross section B-B of the side view of the feeding chute 140 in FIG. 14B.

FIG. 13A schematically illustrates a side view of the feeding chute 140 in an elevated state according to an embodiment of the present disclosure.

In FIG. 13A, the weapon is according to a variant in a horizontal position, e.g. as illustrated in FIG. 5, wherein the end of the feeding chute 140 connected to the weapon including the element 142A closest to the weapon also has a corresponding horizontal arrangement. The element 142A of the set of elements 142 of the feeding chute 140 configured to be closest to the weapon is below denoted first end element 142A.

The element 142E of the set of elements 142 of the feeding chute 140 furthest away from the weapon has a certain inclination with an angle β between the maximum elevation angle and minimum elevation angle of the weapon. The element 142E of the set of elements 142 of the feeding chute 140 configured to be furthest away from the weapon 20 is below denoted second end element 142E.

The feeding chute 140 has a first side 140*a* and an opposite second side 140*b*, see e.g. FIG. 13A. The feeding chute 140 has a third side 140*c* and an opposite fourth side 140*d*, see e.g. FIG. 13A. The first side 140*a* and opposite second side 140*b* are essentially perpendicular to the third side 140*c* and an opposite fourth side 140*d*, providing a rectangular configuration. The feeding chute has a connection side 140*e* for connection to the weapon and an opposite receiving side 140*f*, see e.g. FIG. 14B. The connection side 140*e* and receiving side 140*f* are surrounded by the first side 140*a*, second side 140*b*, third side 140*c* and fourth side 140*d*, forming the feeding chute 140.

For the feeding chute 140, when connected to a weapon on a vehicle being in an essentially horizontal position, the first longitudinal side 140*a* is the upper side 140*a*, the opposite second longitudinal side 140*b* is the lower side 140*b*, the third side 140*c* is the front side 140*c*, i.e. directed in the direction of the gun barrel of the weapon, i.e. shooting direction, and the fourth side 140*d* is the rear side 140*d*. The sides 140*a*, 140*b*, 140*c*, 140*d*, 140*e* and 140*f* will be referred to as if the feeding chute 140 is connected to a weapon on a vehicle, e.g. a vehicle V according to FIG. 1.

The feeding chute 140 comprises said set of elements 142 assembled together in a stacked configuration. The set of elements 142 is arranged about a shaft 144 configured to be concentrically arranged relative to the elevation axis so as to allow movement of individual elements 142A, 142B, 142C, 142D, 142E of the set of elements 142 about said shaft 144 in connection to elevation movement of the weapon about the elevation axis Z1, see e.g. FIG. 10A. The respective individual element of the set of elements 142 has an extension essentially perpendicular to the direction of the shaft 144. The respective individual element of the set of elements 142 has a rotational plane essentially perpendicular to the direction of the shaft 144.

According to an aspect of the present disclosure, the shaft 144 may comprise a shaft joint member J144 arranged in connection to the receiving side 140*f*, see e.g. FIG. 14B and FIG. 18. The shaft joint member J144 comprises a shaft protrusion portion J144*a* configured to protrude from the receiving side. The shaft protrusion portion J144*a* is configured to facilitate connection to and removal from the intermediate chute 50. According to an aspect of the present disclosure, the shaft protrusion portion J144*a* is configured to movably connect to a track portion of the intermediate chute 50, said track portion being configured to face the receiving side 140*f* of the feeding chute 140. Hereby easy attachment and removal of the feeding chute may be facilitated.

The individual elements 142A, 142B, 142C, 142D, 142E of the feeding chute 140, when moved, are only pivoted about the shaft 144, i.e. only in a plane essentially orthogonal to the elevation axis. The individual elements 142A, 142B, 142C, 142D, 142E are configured to be arranged a certain distance in the axial direction of said shaft 144 relative to an adjacent element. Thus the respective element of the individual elements 142A, 142B, 142C, 142D, 142E of the set of element 142 is arranged at a certain distance from an adjacent element so that the first end element 142A is pivotably arranged about the shaft 144 in connection to the connection side 140*e*, a first intermediate element 142B adjacent to the first end element 142A is pivotably arranged about the shaft 144 a certain distance from element 142A, a second intermediate element 142C adjacent to the first intermediate element 142B is pivotably arranged about the shaft 144 a certain distance from element 142B, a third intermediate element 142D adjacent to the second intermediate element 142C is pivotably arranged about the shaft 144 a certain distance from element 142C, and the second end element 142E adjacent to the third intermediate element 142D is pivotably arranged about the shaft 144 a certain distance from element 142D in connection to the receiving side. This is facilitated by the rotation of the individual elements of the set of element 142 in only one plane. In the embodiment of the feeding chute 140 disclosed in e.g. FIGS. 11A-11B, 12A-12B, 13A-13B, 14A-14B, 15, 16 and 17A-17B, the set of element 142 constitutes five individual elements 142A, 142B, 142C, 142D, 142E arranged a certain distance from each other. The number of individual elements of the set of elements may however be any suitable number of elements and may be more than five or less than five elements. According to an aspect of the present disclosure the feeding chute 140 is equipped with a gliding arrangement 200 arranged in connection to the individual elements 142A, 142B, 142C, 142D, 142E so as to facilitate feeding of ammunition through the respective individual elements of the feeding chute 140. The gliding arrangement 200 is described in more detail below.

The feeding chute 144 comprises a set of distance members 4AB, 4BC, 4CD, 4DE arranged in connection to the shaft 144 between the respective element of the set of elements 142 so as to hold the individual elements 142A, 142B, 142C, 142D, 142E together in the axial direction, i.e. direction of the shaft 144, see e.g. FIG. 14B and FIG. 18. The individual distance member of the set of distance members 4AB, 4BC, 4CD, 4DE are configured to be arranged around the shaft 144 so as to facilitate preventing movement of the individual elements 142A, 142B, 142C, 142D, 142E relative to each other in the axial direction of the shaft.

The set of distance members 4AB, 4BC, 4CD, 4DE comprises a first distance member 4AB arranged around the portion of the shaft 144 running between the first end element 142A and the first intermediate element 142B. The set of distance members 4AB, 4BC, 4CD, 4DE comprises a second distance member 4BC arranged around the portion of the shaft 144 running between the first intermediate element 142B and the second intermediate element 142C. The set of distance members 4AB, 4BC, 4CD, 4DE comprises a third distance member 4CD arranged around the portion of the shaft running between the second intermediate element 142C and the third intermediate element 142D. The set of distance members 4AB, 4BC, 4CD, 4DE comprises a fourth distance member 4DE arranged around the portion of the shaft running between third intermediate element 142D and the second end element 142E.

According to an aspect of the present disclosure, the feeding chute 140 comprises an upper channel C1 for feeding ammunition and a lower channel C2 for feeding ammunition. The upper channel C1 may thus constitute a portion of the first channel C1 of the chute configuration C described with reference to e.g. FIG. 10A. The lower channel C2 may thus constitute a portion of the second channel C2 of the chute configuration C described with reference to e.g. FIG. 10A.

According to an aspect of the present disclosure, the shaft 144 is arranged between the upper and lower channel. According to an aspect of the present disclosure, the feeding chute 140 comprises an intermediate portion 140*i* configured to run between the upper channel C1 and lower channel C2. The intermediate portion 140*i* is configured to divide the feeding chute 140 into two channels C1, C2. The intermediate portion 140*i* thus has an extension corresponding to the extension of the channels C1, C2. The shaft 144 is arranged to run through the intermediate portion 140*i*. Each individual element thus has an intermediate portion forming the intermediate portion 140*i* when assembled together.

The upper channel C1 and the lower channel C2 has a shape essentially corresponding to the shape of the ammunition. The upper channel C1 and the lower channel C2 thus is narrower in connection to the short side 140*c*, i.e. the side 140*c* directed in the direction of the gun barrel of the weapon, see e.g. FIGS. 13A and 14A.

According to an aspect of the present disclosure, the feeding chute 140 comprises an upper opening O1 arranged at the upper side 140*a* so as to facilitate manual introduction into the weapon of an individual round of the linked-together ammunition from the upper channel C1, see FIG. 14A.

According to an aspect of the present disclosure, the feeding chute 140 comprises lower opening O2 arranged at the lower side 140*b* so as to facilitate manual introduction into the weapon of an individual round of the linked-together ammunition from the lower channel C2, see FIG. 14A.

The feeding chute according to the present disclosure may alternatively be configured with a single channel. The feeding chute according to the present disclosure may be configured with any suitable number of channels.

The individual elements of the feeding chute 140 are, according to an aspect of the present disclosure, formed in one piece.

The individual elements of the feeding chute 140 have a plate configuration. The individual elements of the feeding chute 140 may be denoted plate elements or plate members.

The individual elements 142A, 142B, 142C, 142D, 142E of the feeding chute 140 have an upper side forming the upper side 140*a* of the feeding chute 140 when assembled together with the rest of the set of elements 142.

The individual elements 142A, 142B, 142C, 142D, 142E of the feeding chute 140 have a lower side forming the lower side 140*b* of the feeding chute 140 when assembled together with the rest of the set of elements 142.

The individual elements of the feeding chute 140 have a front side forming the front side 140*c* of the feeding chute 140 when assembled together with the rest of the set of elements 142.

The individual elements 142A, 142B, 142C, 142D, 142E of the feeding chute 140 have a rear side forming the rear side 140*d* of the feeding chute 140 when assembled together with the rest of the set of elements 142.

According to an aspect of the present disclosure, the feeding chute 140, in connection to said connection end 140*e* of the feeding chute 140, comprises a support frame 146 for supporting the set of elements 142 having an upper frame portion 146*a* arranged on the upper side 140*a* and a lower frame portion 146*b* arranged on the lower side 140*b*, see e.g. FIG. 13A. The support frame 146 is configured to be fixedly attached to the weapon.

According to an aspect of the present disclosure, the feeding chute 140, in connection to said connection end 140*e* of the feeding chute 140, comprises a fastening arrangement 147 for attaching the feeding chute 140 to the weapon.

The fastening arrangement 147 comprises a pair of locking members 147*a*, 147*b* for lockingly attach the feeding chute 140 to the weapon. The fastening arrangement 147 is attached to the support frame 146. The support frame 146 is here configured to be fixedly attached to the weapon by means of the fastening arrangement 147.

The feeding chute 140 is configured to be attached to the weapon by means of the fastening arrangement 147 so that the element closest to the weapon, below denoted first end element 142A, is rotated about the shaft 144 corresponding to the elevation movement of the weapon. The feeding chute 140 may be attached to the weapon by means of any suitable fastening arrangement.

According to an aspect of the present disclosure, the feeding chute 140 comprises a first end element 142A configured to be closest to the weapon. The first end element 142A is arranged at the connection side 140*e*, see e.g. FIG. 14A.

The first end element 142A is configured to be pivoted about the shaft 144 corresponding to the elevation movement of the weapon about the elevation axis. The first end element 142A is according to an aspect of the present disclosure configured to fixedly attached to the support frame 146.

According to an aspect of the present disclosure, the feeding chute 140 comprises a second end element 142E configured to be furthest away from the weapon. The second end element 142E is arranged at the receiving side 140*f* opposite to the connection side 140*e*.

The second end element 142E is according to an aspect of the present disclosure configured to be essentially fixed so that it is at the same position independently of elevation angle of the weapon thus connected to the feeding chute 140. The second end element 142E is configured to be essentially fixed to the guiding chute, see e.g. FIGS. 10A-10B, so that feeding of ammunition from the guiding chute may be easily obtained independent of elevation angle of the weapon. Thus, the second end element 142E is configured to be essentially fixed to the guiding chute so that the ammunition may be introduced to the feeding chute 140 via the connected guiding chute.

According to an aspect of the present disclosure, the elements 142B, 142C, 142D of the set of elements 142 between the first end element 142A and the second end element 142E are gradually mutually displaceable. The individual elements are according to an embodiment configured to be mutually displaced based on elevation angle so as to allow ammunition to be fed through the channels C1, C2 of the feeding chute 140.

According to an aspect of the present disclosure, the individual elements movable about said shaft 144 are configured to be rotated about the shaft 144 a certain angle relative to an adjacent element so as to allow feeding of ammunition through the feeding chute 140 at all elevation angles of the elevation device.

The feeding chute 140 comprises a gliding arrangement 200 arranged in connection to the individual elements 142A, 142B, 142C, 142D, 142E so as to facilitate feeding of ammunition through the respective individual elements of the feeding chute 140.

According to an aspect of the present disclosure the gliding arrangement 200 comprises a set of gliding members 210, 220, 230, 240, 250, 260, 270, 280 arranged at a distance from each other within the channels C1, C2 of the feeding chute. The set of gliding members 210, 220, 230, 240, 250, 260, 270, 280 are configured to run in the feeding direction as to facilitate feeding of ammunition through the respective individual elements 142A, 142B, 142C, 142D, 142E of the feeding chute 140. The set of gliding members 210, 220, 230, 240, 250, 260, 270, 280 are thus configured to run in a direction essentially corresponding to the axial direction of the shaft so as to facilitate feeding of ammunition through the respective individual elements 142A, 142B, 142C, 142D, 142E of the feeding chute 140. The individual gliding members of the set of gliding members 210, 220, 230, 240, 250, 260, 270, 280 have a longitudinal extension configured to run in the feeding direction of said channels C1, C2.

According to an aspect of the present disclosure the gliding arrangement 200 comprises upper and lower gliding members, upper gliding members being configured to be arranged in the upper part of a channel of the feeding chute 140 and lower gliding members being configured to be arranged in the lower part of a channel of the feeding chute 140.

According to an aspect of the present disclosure the gliding arrangement 200 comprises two upper and two lower gliding members for each channel of the feeding chute 140. Thus, for a feeding chute with only one channel, the gliding arrangement 200 would, according to an aspect of the present disclosure, comprise two upper and two lower gliding members.

According to an aspect of the present disclosure individual gliding members of the gliding arrangement 200 comprises gliding rails overlappingly arranged so as to allow relative movement of said gliding rails for facilitating mutual rotational movement of individual feeding elements 142A, 142B, 142C, 142D, 142E about said shaft 144.

According to an aspect of the present disclosure individual gliding rails of gliding members of the gliding arrangement 200 are overlappingly arranged so that the gliding rail closest to the feeding side 140*f*, i.e. the side from which ammunition is configured to be fed, is overlapping the following gliding rail and so on.

According to an aspect of the present disclosure individual gliding members of the gliding arrangement 200 comprises gliding rails being arranged relative to each other so as to provide a telescopic function for facilitating relative movement of said gliding rails for facilitating mutual rotational movement of individual feeding elements 142A, 142B, 142C, 142D, 142E about said shaft 144.

According to an aspect of the present disclosure individual gliding rails of individual gliding members are attached to one feeding element so as to allow relative movement of said gliding rails for facilitating mutual rotational movement of individual feeding elements 142A, 142B, 142C, 142D, 142E about said shaft 144.

According to an aspect of the present disclosure individual gliding rails of individual gliding members are attached to one feeding element so that said gliding rails are allowed to move relative to each other based on rotational movement of individual feeding elements 142A, 142B, 142C, 142D, 142E about said shaft 144.

According to an aspect of the present disclosure individual gliding rails of individual gliding members have a gliding surface configured to face the ammunition during feeding of ammunition through the feeding chute 140.

According to an aspect of the present disclosure the number of individual gliding rails of individual gliding members are based on the degree of elevation of the weapon, i.e. range between the maximum elevation angle and minimum elevation angle of the weapon, and thus the range of the rotational movement of the individual feeding elements 142A, 142B, 142C, 142D, 142E about said shaft 144.

According to an aspect of the present disclosure the number of individual gliding rails of individual gliding members depends on the degree of elevation of the weapon, i.e. range between the maximum elevation angle and minimum elevation angle of the weapon, and thus the range of the rotational movement of the individual feeding elements 142A, 142B, 142C, 142D, 142E about said shaft 144.

According to an aspect of the present disclosure the number of individual gliding rails of individual gliding members may depend on the location of the individual gliding member. A gliding member arranged centrally of the feeding chute 140, e.g. in connection to the intermediate portion 140*i*, may require less gliding rails as they are located closer to the shaft 144.

According to an aspect of the present disclosure individual gliding members of the gliding arrangement 200 comprises guide rails being arranged in connection to gliding rails of a gliding member so as to guide and hence control movement of the gliding rails.

According to an aspect of the present disclosure guide rails of individual gliding members have a longitudinal extension configured to run in essentially the same direction as the associated gliding rails, and hence the feeding direction of said channels C1, C2.

According to an aspect of the present disclosure guide rails of individual gliding members being arranged in connection to gliding rails of that gliding member are configured to run through openings of elements, said openings being arranged in connection to the location of that gliding member.

According to an aspect of the present disclosure guide rails of individual gliding members being arranged in connection to gliding rails of that gliding member may be configured to be movably arranged based on rotational movement of individual feeding elements 142A, 142B, 142C, 142D, 142E about said shaft 144.

According to an aspect of the present disclosure guide rails of individual gliding members being arranged in connection to gliding rails of that gliding member may be configured to be movably arranged based on movement of gliding rails of that gliding member.

According to an aspect of the present disclosure the number of guide rails of individual gliding members being arranged in connection to gliding rails of that gliding member may depend on the location of gliding member. A gliding member arranged centrally of the feeding chute 140 may require less guide rails as they are located closer to the shaft 144, than a gliding member arranged in connection to the front side or rear side, i.e. further away from the shaft 144.

According to an aspect of the present disclosure guide rails arranged in connection to the front side and/or rear side may require two guide rails. Such guide rails may be overlappingly arranged and movably arranged relative to each other based on rotational movement of individual feeding elements 142A, 142B, 142C, 142D, 142E about said shaft 144. Such guide rails may be overlappingly arranged and movably arranged relative to each other based on movement of gliding rails of that gliding member to which a guide rail is connected.

According to an aspect of the present disclosure guide rails arranged centrally of the feeding chute 140 may require one guide rail. Such a single guide rail may be movably and connectably arranged in connection to end elements. Such a single guide rail may comprise tracks in connection to its respective end portion for allowing said connection and movement, said movement being based on rotational movement of individual feeding elements 142A, 142B, 142C, 142D, 142E about said shaft 144.

According to an aspect of the present disclosure the gliding arrangement 200 comprises control members for further facilitating connection and control of gliding rails by means of guide rails. According to an aspect of the present disclosure such control members are attached to gliding rails of gliding members and configured to face towards and to further facilitate movable connection of guide rails. According to an aspect of the present disclosure such control members are provided with openings through which guide rails are configured to run. According to an aspect of the present disclosure such control members may have a U-shaped configuration with the base being arranged in connection to a gliding rail and the legs being provided with said openings.

According to an aspect of the present disclosure the gliding arrangement 200 comprises a first gliding member 210 arranged in the central upper part of the upper channel C1 of the feeding chute 140. The first gliding member 210 is thus configured to be arranged in connection to a central part of the upper side 140*a*.

Figure 11A:
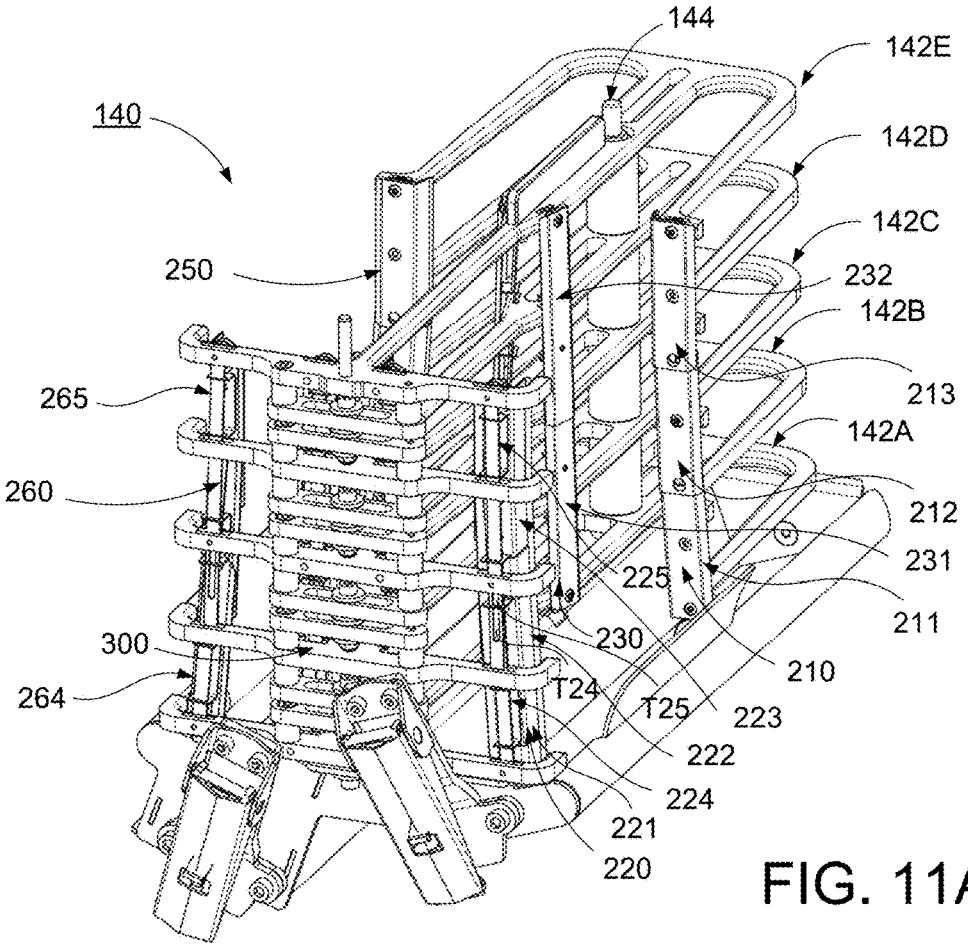
FIG. 11A schematically illustrates a perspective view of a feeding chute according to an embodiment of the present disclosure.

According to an aspect of the present disclosure the first gliding member 210 comprises three gliding rails of 211, 212, 213, see e.g. FIG. 11A, overlappingly arranged so as to allow relative movement of said gliding rails of 211, 212, 213 for facilitating mutual rotational movement of individual feeding elements 142A, 142B, 142C, 142D, 142E about said shaft 144. According to an aspect of the present disclosure the first gliding member 210 comprises a first gliding rail 211 fixedly connected to the first end element 142A, a second gliding rail 212 fixedly connected to the second intermediate element 142C and a third gliding rail 213 fixedly connected to the second end element 142E.

According to an aspect of the present disclosure said gliding rails of 211, 212, 213 have an angled configuration with the an attachment portion and a gliding portion with a gliding surface configured to face towards ammunition being fed through the upper channel C1 of the feeding chute 140.

According to an aspect of the present disclosure the first gliding member 210 comprises a single guide rails 214 being arranged in connection to the gliding rails 211, 212, 213 of the first gliding member 210 so as to guide and hence control movement of the gliding rails 211, 212, 213.

According to an aspect of the present disclosure the guide rail 214 is movably connected to the first end element 142A in connection to a first end portion and movably connected to the second end element 142E in connection to its second end portion opposite to the first end portion. The guide rail 214 is according to an aspect of the present disclosure movably connected to the first end element 142A by means of the same joint member as the first gliding member 211. The guide rail 214 is according to an aspect of the present disclosure movably connected to the second end element 142E by means of the same joint member as the third gliding member 213. The guide rail 214 is according to an aspect of the present disclosure configured to run through openings of said set of elements 142.

According to an aspect of the present disclosure the guide rail 114 has a track configured to run in connection to the first end element 142A so as to facilitate relative movement relative to a joint member running through the opening of the first end element 142A for attaching the first gliding member 211.

According to an aspect of the present disclosure the guide rail 114 has a track configured to run in connection to the second end element 142E so as to facilitate relative movement relative to a joint member running through the opening of the second end element 142E for attaching the third gliding member 213.

The tracks of the first guide rail 214 are arranged so as to allow limited relative rotational movement of said set of elements 142 about said shaft 144. The tracks of the first guide rail 214 are according to an aspect arranged so as to allow limited relative movement of said gliding rails relative to said guide rail 214.

According to an aspect of the present disclosure the gliding member 210 comprises control members for further facilitating connection and control of the gliding rails by means of the pair of guide rails, the control members according to an aspect essentially corresponding to control members for the gliding member 220 described below with reference to FIG. 17B. According to an aspect of the present disclosure the gliding arrangement 200 comprises a second gliding member 220 arranged in the rear upper part of the upper channel C1 of the feeding chute 140. The second gliding member 220 is thus configured to be arranged in connection to the upper side 140*a* and rear side 140*d*.

According to an aspect of the present disclosure the second gliding member 220 comprises three gliding rails of 221, 222, 223, see e.g. FIG. 11A and FIG. 17B, overlappingly arranged so as to allow relative movement of said gliding rails of 221, 222, 223 for facilitating mutual rotational movement of individual feeding elements 142A, 142B, 142C, 142D, 142E about said shaft 144. According to an aspect of the present disclosure the second gliding member 220 comprises a first gliding rail 221 fixedly connected to the first end element 142A, a second gliding rail 222 fixedly connected to the second intermediate element 142C and a third gliding rail 223 fixedly connected to the second end element 142E. The first gliding rail 221 may be fixedly connected to the first end element 142A by means of a joint member J2A. The second gliding rail 222 may be fixedly connected to the second intermediate element 142C by means of a joint member J2C. The third gliding rail 223 may be fixedly connected to the second end element 142E by means of a joint member J2E, see e.g. FIG. 15 and FIG. 17B.

According to an aspect of the present disclosure said gliding rails of 221, 222, 223 have an angled configuration with the an attachment portion and a gliding portion with a gliding surface configured to face towards ammunition being fed through the upper channel C1 of the feeding chute 140.

According to an aspect of the present disclosure the second gliding member 220 comprises a first guide rail 224 fixedly connected to the first end element 142A. The first guide rail 224 is according to an aspect of the present disclosure fixedly connected to the first end element 142A by means of the same joint member J2A as the first gliding member 221, see FIG. 17B. The first guide rail 224 is according to an aspect of the present disclosure configured to run through an opening OA of the first end element 142A, an opening OB of the first intermediate element 142B and an opening OC of the second intermediate element 142C, being movably arranged relative to first intermediate element 142B and the second intermediate element 142C. According to an aspect of the present disclosure the first guide rail 224 has a track T24, see FIG. 11A, configured to run in connection to the second intermediate element 142C so as to facilitate relative movement relative to a joint member J2C running through the opening OC of second intermediate element 142C for attaching the second gliding member 222, see FIG. 15 and FIG. 17B. The first guide rail 224 is thus movably arranged relative to the second gliding member 222.

According to an aspect of the present disclosure the second gliding member 220 comprises a second guide rail 225 fixedly connected to the second end element 142E. The second guide rail 225 is according to an aspect of the present disclosure fixedly connected to the second end element 142E by means of the same joint member J2E as the third gliding member 223, see FIG. 17B. The second guide rail 225 is according to an aspect of the present disclosure configured to run through an opening OE of the second end element 142E, an opening OD of the third intermediate element 142D and an opening OC of the second intermediate element 142C, being movably arranged relative to third intermediate element 142D and the second intermediate element 142C. According to an aspect of the present disclosure the second guide rail 225 has a track T25 configured to run in connection to the second intermediate element 142C so as to facilitate relative movement relative to the joint member J2C running through the opening OC of second intermediate element 142C for attaching the second gliding member 222. The second guide rail 225 is thus movably arranged relative to the second gliding member 222. According to an aspect of the present disclosure the second guide rail 225 is overlappingly arranged in connection to the second intermediate element 142C. The track of the first guide rail 224 and second guide rail 225 are arranged so as to allow limited relative rotational movement of said set of elements 142 about said shaft 144. Said joint member running through the opening of the second intermediate element 142C providing a stop for the respective guide rail by acting against the respective end of the respective track of the pair of guide rails 224, 225.

According to an aspect of the present disclosure the gliding member 220 comprises control members U21, U22, U23 for further facilitating connection and control of the gliding rails 221, 222, 223 by means of the pair of guide rails 224, 225. Said control members may also be denoted control brackets or control bracket members. According to an aspect of the present disclosure the gliding member comprises a first control member U21 attached to the first gliding rail 221, a second control member U22 attached to the second gliding rail 222 and a third control member U23 attached to the third gliding rail 223. According to an aspect of the present disclosure the respective control member U21, U22, U23 has a U-shaped configuration with the base being arranged in connection to the respective gliding rail 221, 222, 223 and the legs being provided with said openings. See FIG. 17B.

According to an aspect of the present disclosure the gliding arrangement 200 comprises a third gliding member 230 arranged in the central lower part of the upper channel C1 of the feeding chute 140. The third gliding member 230 is thus configured to be arranged in connection to a central upper part of the central portion 140*i* of the feeding chute 140.

According to an aspect of the present disclosure the third gliding member 230 comprises two gliding rails of 231, 232, see e.g. FIG. 11A, overlappingly arranged so as to allow relative movement of said gliding rails of 231, 232 for facilitating mutual rotational movement of individual feeding elements 142A, 142B, 142C, 142D, 142E about said shaft 144. According to an aspect of the present disclosure the third gliding member 230 comprises a first gliding rail 231 fixedly connected to the first end element 142A and a second gliding rail 232 fixedly connected to the second end element 142E.

According to an aspect of the present disclosure the third gliding member 230 may comprise a single guide rail 234, see FIG. 16, being arranged and having essentially the same function as the guide rail 214 of the first gliding member 210.

According to an aspect of the present disclosure the gliding member 230 comprises control members for further facilitating connection and control of the gliding rails by means of the guide rail 234, the control members according to an aspect essentially corresponding to control members for the gliding member 220 described above with reference to FIG. 17B.

According to an aspect of the present disclosure the gliding arrangement 200 comprises a fourth gliding member 240 arranged in the central rear part of the upper channel C1 of the feeding chute 140. The fourth gliding member 240 is thus configured to be arranged in connection to a central part of the rear side 140*d*.

Figure 12A:
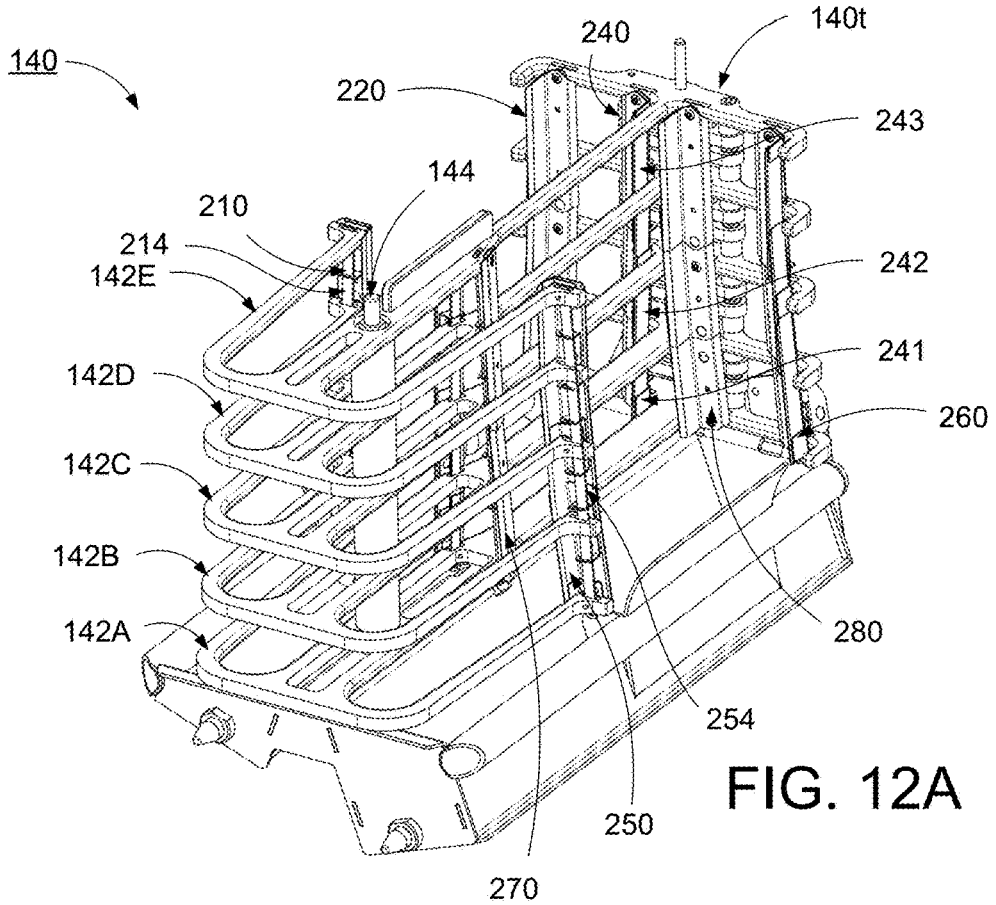
FIG. 12A schematically illustrates another perspective view of the feeding chute in FIG. 11A.

According to an aspect of the present disclosure the fourth gliding member 240 comprises three gliding rails of 241, 242, 243, see e.g. FIG. 12A, overlappingly arranged so as to allow relative movement of said gliding rails of 241, 242, 243 for facilitating mutual rotational movement of individual feeding elements 142A, 142B, 142C, 142D, 142E about said shaft 144. According to an aspect of the present disclosure the fourth gliding member 240 comprises a first gliding rail 241 fixedly connected to the first end element 142A, a second gliding rail 242 fixedly connected to the second intermediate element 142C and a third gliding rail 243 fixedly connected to the second end element 142E.

According to an aspect of the present disclosure said gliding rails of 241, 242, 243 have an angled configuration with the an attachment portion and a gliding portion with a gliding surface configured to face towards ammunition being fed through the upper channel C1 of the feeding chute 140.

According to an aspect of the present disclosure the fourth gliding member 240 may comprise guide rails being arranged and having essentially the same function as the guide rails 224, 225 of the second gliding member 220.

According to an aspect of the present disclosure the gliding member 240 comprises control members for further facilitating connection and control of the gliding rails by means of the pair of guide rails, the control members according to an aspect essentially corresponding to control members for the gliding member 220 described above with reference to FIG. 17B.

According to an aspect of the present disclosure the gliding arrangement 200 comprises a fifth gliding member 250 arranged in the central lower part of the lower channel C2 of the feeding chute 140. The fifth gliding member 250 is thus configured to be arranged in connection to the a central part of the lower side 140*b*.

According to an aspect of the present disclosure the fifth gliding member 250 comprises three gliding rails of 251, 252, 253, see e.g. FIG. 12A, overlappingly arranged so as to allow relative movement of said gliding rails of 251, 252, 253 for facilitating mutual rotational movement of individual feeding elements 142A, 142B, 142C, 142D, 142E about said shaft 144. According to an aspect of the present disclosure the fifth gliding member 250 comprises a first gliding rail 251 fixedly connected to the first end element 142A, a second gliding rail 252 fixedly connected to the second intermediate element 142C and a third gliding rail 253 fixedly connected to the second end element 142E.

According to an aspect of the present disclosure said gliding rails of 251, 252, 253 have an angled configuration with the an attachment portion and a gliding portion with a gliding surface configured to face towards ammunition being fed through the lower channel C2 of the feeding chute 140.

According to an aspect of the present disclosure the fifth gliding member 250 may comprise a single guide rail 254, see FIG. 12A, being arranged and having essentially the same function as the guide rail 214 of the first gliding member 210.

According to an aspect of the present disclosure the gliding member 250 comprises control members for further facilitating connection and control of the gliding rails by means of the guide rail 254, the control members according to an aspect essentially corresponding to control members for the gliding member 220 described above with reference to FIG. 17B.

According to an aspect of the present disclosure the gliding arrangement 200 comprises a sixth gliding member 260 arranged in the rear lower part of the lower channel C2 of the feeding chute 140. The sixth gliding member 260 is thus configured to be arranged in connection to the lower side 140*b* and rear side 140*d*.

According to an aspect of the present disclosure the sixth gliding member 260 comprises three gliding rails of 261, 262, 263, see e.g. FIG. 12A, overlappingly arranged so as to allow relative movement of said gliding rails of 261, 262, 263 for facilitating mutual rotational movement of individual feeding elements 142A, 142B, 142C, 142D, 142E about said shaft 144. According to an aspect of the present disclosure the sixth gliding member 260 comprises a first gliding rail 261 fixedly connected to the first end element 142A, a second gliding rail 262 fixedly connected to the second intermediate element 142C and a third gliding rail 263 fixedly connected to the second end element 142E. The first gliding rail 261 may be fixedly connected to the first end element 142A by means of a joint member J6A. The second gliding rail 222 may be fixedly connected to the second intermediate element 142C by means of a joint member J6C. The third gliding rail 223 may be fixedly connected to the second end element 142E by means of a joint member J6E, see e.g. FIG. 15.

According to an aspect of the present disclosure said gliding rails of 261, 262, 263 have an angled configuration with the an attachment portion and a gliding portion with a gliding surface configured to face towards ammunition being fed through the lower channel C2 of the feeding chute 140.

According to an aspect of the present disclosure the sixth gliding member 260 comprises a first guide rail 264 and a second guide rail 265, said guide rails 264, 265 being arranged and having essentially the same function as the guide rails 224, 225 of the second gliding member 220.

According to an aspect of the present disclosure the gliding member 260 comprises control members for further facilitating connection and control of the gliding rails by means of the pair of guide rails 264, 265, the control members according to an aspect essentially corresponding to control members for the gliding member 220 described above with reference to FIG. 17B.

According to an aspect of the present disclosure the gliding arrangement 200 comprises a seventh gliding member 270 arranged in the central upper part of the lower channel C2 of the feeding chute 140. The seventh gliding member 270 is thus configured to be arranged in connection to a central lower part of the central portion 140*i* of the feeding chute 140.

Figure 11B:
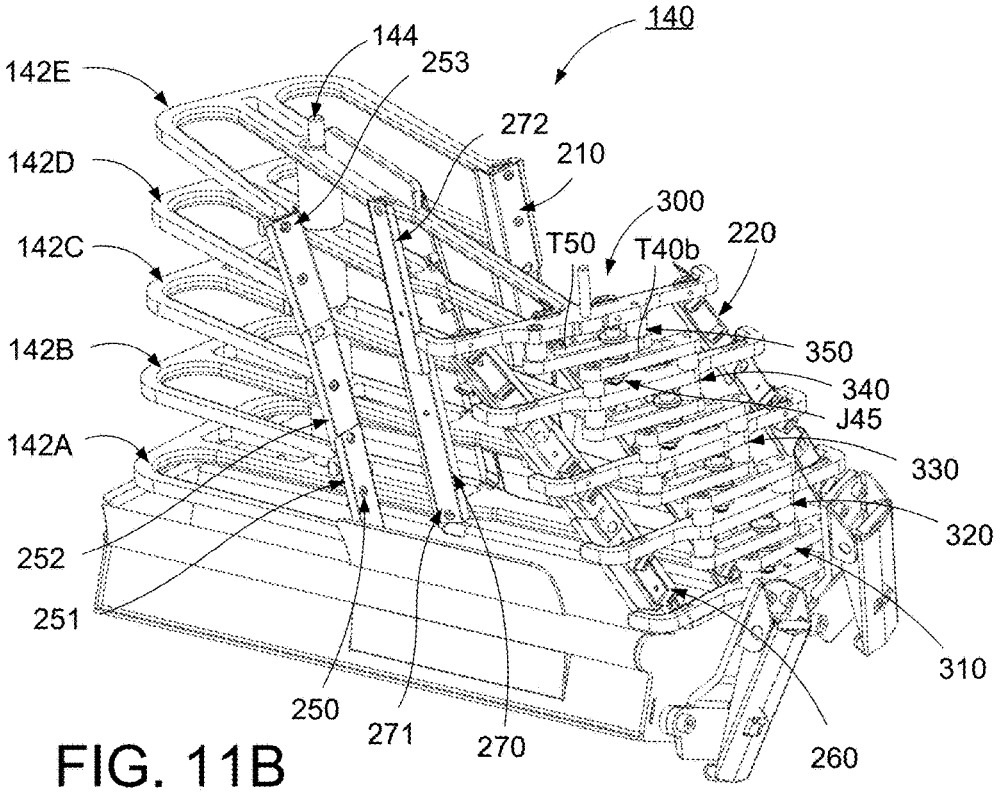
FIG. 11B schematically illustrates another perspective view of the feeding chute in FIG. 11A.

According to an aspect of the present disclosure the seventh gliding member 270 comprises two gliding rails of 271, 272, see e.g. FIG. 11B, overlappingly arranged so as to allow relative movement of said gliding rails of 271, 272 for facilitating mutual rotational movement of individual feeding elements 142A, 142B, 142C, 142D, 142E about said shaft 144. According to an aspect of the present disclosure the seventh gliding member 270 comprises a first gliding rail 271 fixedly connected to the first end element 142A and a second gliding rail 272 fixedly connected to the second end element 142E.

According to an aspect of the present disclosure the seventh gliding member 270 may comprise a single guide rail 274, see FIG. 16, being arranged and having essentially the same function as the guide rail 214 of the first gliding member 210.

According to an aspect of the present disclosure the gliding member 270 comprises control members for further facilitating connection and control of the gliding rails by means of the guide rail 274, the control members according to an aspect essentially corresponding to control members for the gliding member 220 described above with reference to FIG. 17B.

According to an aspect of the present disclosure the gliding arrangement 200 comprises an eighth gliding member 280 arranged in the central rear part of the lower channel C2 of the feeding chute 140. The eighth gliding member 280 is thus configured to be arranged in connection to a central part of the rear side 140*d*.

Figure 12B:
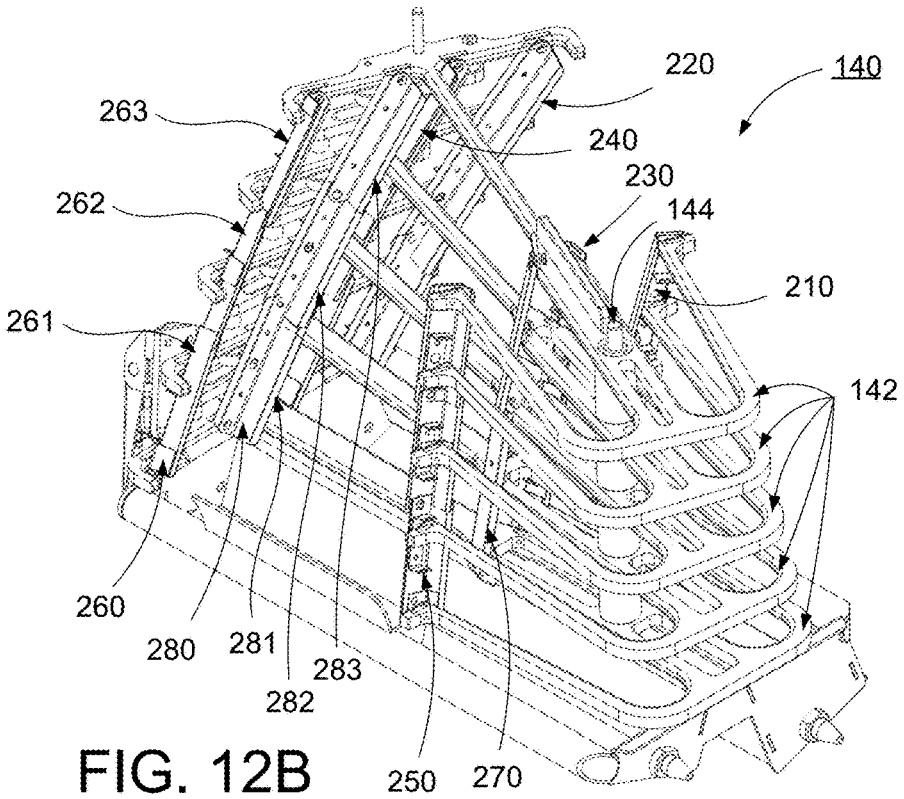
FIG. 12B schematically illustrates another perspective view of the feeding chute in FIG. 11A.

According to an aspect of the present disclosure the eighth gliding member 280 comprises three gliding rails of 281, 282, 283, see e.g. FIG. 12B, overlappingly arranged so as to allow relative movement of said gliding rails of 281, 282, 283 for facilitating mutual rotational movement of individual feeding elements 142A, 142B, 142C, 142D, 142E about said shaft 144. According to an aspect of the present disclosure the eighth gliding member 280 comprises a first gliding rail 281 fixedly connected to the first end element 142A, a second gliding rail 282 fixedly connected to the second intermediate element 142C and a third gliding rail 283 fixedly connected to the second end element 142E.

According to an aspect of the present disclosure said gliding rails of 281, 282, 283 have an angled configuration with the an attachment portion and a gliding portion with a gliding surface configured to face towards ammunition being fed through the lower channel C2 of the feeding chute 140.

According to an aspect of the present disclosure the eighth gliding member 280 may comprise guide rails being arranged and having essentially the same function as the guide rails 224, 225 of the second gliding member 220.

According to an aspect of the present disclosure the gliding member 280 comprises control members for further facilitating connection and control of the gliding rails by means of the pair of guide rails, the control members according to an aspect essentially corresponding to control members for the gliding member 220 described above with reference to FIG. 17B.

According to an aspect of the present disclosure individual gliding rails of individual gliding members are attached to one feeding element so that said gliding members are allowed to move relative to each other based on rotational movement of individual feeding elements 142A, 142B, 142C, 142D, 142E about said shaft 144.

In FIGS. 11B and 12B guide rails are not shown.

The rotation of the individual elements about said shaft 144 are, according to an aspect of the present disclosure, set to a maximum rotation angle so that the displacement relative to adjacent elements is such that ammunition may be fed through the feeding chute 140 by means of said gliding members of the gliding arrangement 200 without interruption and thus easily and efficiently obtained.

The number of elements of the set of elements 142 and the distance between said set of elements are chosen such that, with such a maximum rotation angle of individual elements, the feeding chute 140 with the set of elements 142 movably arranged about the shaft 144 will facilitate feeding of ammunition by means of said gliding members of the gliding arrangement 200 through the feeding chute 140, i.e. through the channels C1, C2 of the feeding chute 140, at all elevation angles of the weapon.

The feeding chute 140 comprises a rotation limit arrangement 300 configured to limit rotation of the individual elements 142A, 142B, 142C, 142D, 142E about the shaft 144. See e.g. FIG. 11B and FIG. 15. The rotation limit arrangement 300 essentially has the same function as the track member 40*t* and distance members 48 described above with reference to the feeding chute 40.

The rotation limit arrangement 300 is according to an aspect of the present disclosure arranged in connection to the rear side 140*d* of the feeding chute 140. The rotation limit arrangement 300 is according to an aspect of the present disclosure centrally arranged in connection to the rear side 140*d* of the feeding chute 140.

The rotation limit arrangement 300 is according to an aspect of the present disclosure centrally arranged in connection to the rear side 140*d* of the feeding chute 140, and being arranged from the connection side 140*e* to the receiving side 140*f*.

According to an aspect of the present disclosure, the rotation limit arrangement 300 may comprise or be connected to a joint member J300 arranged in connection to the receiving side 140*f*, see e.g. FIG. 14B and FIG. 15. The joint member J300 comprises a protrusion portion J300*a* configured to protrude from the receiving side 140*f*. The protrusion portion J300*a* is configured to facilitate connection to and removal from the intermediate chute 50. According to an aspect of the present disclosure, the protrusion portion J300*a* is configured to movably connect to a track portion of the intermediate chute 50, said track portion being configured to face the receiving side 140*f* of the feeding chute 140. The protrusion portion J300*a* together with the shaft protrusion portion J144*a* are configured to movably connect to a track portion of the intermediate chute 50, said track portion being configured to face the receiving side 140*f* of the feeding chute 140. Hereby easy attachment and removal of the feeding chute 140 may be facilitated.

The rotation limit arrangement 300 comprises a set of track member portions 310, 320, 330, 340, 350. The set of track member portions 310, 320, 330, 340, 350 comprises individual track member portions. Each individual track member portion 310, 320, 330, 340, 350 of the set of track member portions 310, 320, 330, 340, 350 is arranged in connection to an individual element 142A, 142B, 142C, 142D, 142E of the set of elements 142 of the feeding chute 140.

The rotation limit arrangement 300 for the feeding chute 140 differs from the track member 40*t* and distance members 48 described above with reference to the feeding chute 40, i.e. the rotation limit arrangement 40*t*, 48 of the feeding chute in that tracks for distance member 48 are provided in the respective elements for feeding chute 40 and in track member portions attached to the respective elements for feeding chute 140.

According to an aspect of the present disclosure the set of track member portions 310, 320, 330, 340, 350 comprises tracks. The tracks of the respective track member portions 310, 320, 330, 340, 350 is arranged at a distance from the individual element to which it is connected. The tracks of the respective track member portions 310, 320, 330, 340, 350 is arranged at a distance from an individual element adjacent to the individual element to which it is connected and within the certain distance between those elements.

According to an aspect of the present disclosure the set of track member portions 310, 320, 330, 340, 350 comprises a first end track member portion 310 arranged in connection to the first end element 142A. The first end track member portion 310 is centrally arranged in connection to the rear side of the first end element 142A.

According to an aspect of the present disclosure the first end track member portion 310 is configured to project towards the first intermediate element 142B. According to an aspect of the present disclosure the first end track member portion 310 is configured to project towards the rear side portion of the first intermediate element 142B a part of the distance between the first end element 142A and the first intermediate element 142B in a direction essentially corresponding to the axial extension of the shaft 144.

According to an aspect of the present disclosure the first end track member portion 310 comprises a track portion having a track T10. According to an aspect of the present disclosure, the track portion with the track T10 is configured to run in a direction essentially parallel to the extension of the rear side portion of the first end element 142A at a certain distance from the rear side portion of the first end element 142A. According to an aspect of the present disclosure the first end track member portion 310 is attached to the rear side portion of the first end element 142A by means of a first joint member J10*a* in connection to one end of the track portion and a second joint member J10*b* in connection to the opposite end of the track portion. The first and second joint members may e.g. be screw joint members. The first and second joint members are thus configured to attach the track portion to the first end element 142A, the first joint member and second joint member being attached at a distance from the central portion of the rear end portion of the first end element 142A on opposite sides of said central portion.

The track T10 of the track portion is running in a direction essentially orthogonal to the extension of the shaft 144 and essentially orthogonal to the extension of the intermediate portion of the first end element 142A.

According to an aspect of the present disclosure the set of track member portions 310, 320, 330, 340, 350 comprises a first intermediate track member portion 320 arranged in connection to the first intermediate element 142B. The first intermediate track member portion 320 arranged in connection to the rear side of the first intermediate element 142B.

According to an aspect of the present disclosure the first intermediate track member portion 320 has a first connection portion 320*a* configured to project towards the first end element 142A and hence towards the first end track member portion 310. According to an aspect of the present disclosure the first connection portion 320*a* is configured to project towards the rear side portion of the first end element 142A a part of the distance between the first intermediate element 142B and the first end element 142A in a direction essentially corresponding to the axial extension of the shaft 144.

According to an aspect of the present disclosure the first intermediate track member portion 320 has a second connection portion 320*b* configured to project towards the second intermediate element 142C and hence towards the second intermediate track member portion 330. According to an aspect of the present disclosure the second connection portion 320*b* is configured to project towards the rear side portion of the second intermediate element 142C a part of the distance between the first intermediate element 142B and the second intermediate element 142C in a direction essentially corresponding to the axial extension of the shaft 144.

According to an aspect of the present disclosure the first connection portion 320*a* of the intermediate track member portion 320 comprises a track portion having a track T20*a*. According to an aspect of the present disclosure, the track portion with the track T20*a* is configured to run in a direction essentially parallel to the extension of the rear side portion of the first intermediate element 142B at a certain distance from the rear side portion of the first intermediate element 142B. The track T20*a* of the track portion of the first connection portion 320*a* of the first intermediate track member portion 320 is configured to face the Track T10 of the track portion of the first end track member portion 310.

The track T20*a* of the track portion is running in a direction essentially orthogonal to the extension of the shaft 144 and essentially orthogonal to the extension of the intermediate portion of the first intermediate element 142B.

According to an aspect of the present disclosure the second connection portion 320*b* of the intermediate track member portion 320 comprises a track portion having a track T20*b*. According to an aspect of the present disclosure, the track portion with the track T20*b* is configured to run in a direction essentially parallel to the extension of the rear side portion of the first intermediate element 142B at a certain distance from the rear side portion of the first intermediate element 142B. The track T20*b* of the track portion of the first connection portion 320*a* of the first intermediate track member portion 320 is configured to face a track of a track portion of the second intermediate track member portion 330.

The track T20*b* of the track portion is running in a direction essentially orthogonal to the extension of the shaft 144 and essentially orthogonal to the extension of the intermediate portion of the first intermediate element 142B.

According to an aspect of the present disclosure the first intermediate track member portion 320 with the first connection portion 320*a* and second connection portion 320*b* is attached to the rear side portion of the first intermediate element 142B by means of a first joint member J20*a* in connection to one end of the track portions and a second joint member J20*b* in connection to the opposite end of the track portions. The joint members J20*a* and J20*b* are running through the rear side portion of the first intermediate element 142B so as to attach the first and second connection portions 320*a*, 320*b* to the first intermediate element 142B. The first and second joint members may e.g. be screw joint members. The first and second joint members are thus configured to attach the track portion to the first intermediate element 142B, the first joint member and second joint member being attached at a distance from the central portion of the rear end portion of the first intermediate element 142B on opposite sides of said central portion.

According to an aspect of the present disclosure the set of track member portions 310, 320, 330, 340, 350 comprises a second intermediate track member portion 330 arranged in connection to the second intermediate element 142C. The second intermediate track member portion 330 arranged in connection to the rear side of the second intermediate element 142C.

According to an aspect of the present disclosure the second intermediate track member portion 330 has a first connection portion 330*a* configured to project towards the first intermediate element 142B and hence towards the first intermediate track member portion 320. According to an aspect of the present disclosure the first connection portion 330*a* is configured to project towards the rear side portion of the first intermediate element 142B a part of the distance between the second intermediate element 142C and the first intermediate element 142B in a direction essentially corresponding to the axial extension of the shaft 144.

According to an aspect of the present disclosure the second intermediate track member portion 330 has a second connection portion 330*b* configured to project towards the third intermediate element 142D and hence towards the third intermediate track member portion 340. According to an aspect of the present disclosure the second connection portion 330*b* is configured to project towards the rear side portion of the third intermediate element 142D a part of the distance between the second intermediate element 142C and the third intermediate element 142D in a direction essentially corresponding to the axial extension of the shaft 144.

According to an aspect of the present disclosure the first connection portion 330*a* of the second intermediate track member portion 330 comprises a track portion having a track T30*a*. According to an aspect of the present disclosure, the track portion with the track T30*a* is configured to run in a direction essentially parallel to the extension of the rear side portion of the second intermediate element 142C at a certain distance from the rear side portion of the second intermediate element 142C. The track T30*a* of the track portion of the first connection portion 330*a* of the second intermediate track member portion 330 is configured to face the track T20*b* of the track portion of the second connection portion 320*b* of the first intermediate track member portion 320.

The track T30*a* of the track portion is running in a direction essentially orthogonal to the extension of the shaft 144 and essentially orthogonal to the extension of the intermediate portion of the second intermediate element 142C.

According to an aspect of the present disclosure the second connection portion 330*b* of the second intermediate track member portion 330 comprises a track portion having a track T30*b*. According to an aspect of the present disclosure, the track portion with the track T30*b* is configured to run in a direction essentially parallel to the extension of the rear side portion of the second intermediate element 142C at a certain distance from the rear side portion of the second intermediate element 142C. The track T30*b* of the track portion of the second connection portion 330*b* of the second intermediate track member portion 330 is configured to face a track of a track portion of the third intermediate track member portion 340.

The track T30*b* of the track portion is running in a direction essentially orthogonal to the extension of the shaft 144 and essentially orthogonal to the extension of the intermediate portion of the second intermediate element 142C.

According to an aspect of the present disclosure the second intermediate track member portion 330 with the first connection portion 330*a* and second connection portion 330*b* is attached to the rear side portion of the second intermediate element 142C by means of a first joint member J30*a* in connection to one end of the track portions and a second joint member J30*b* in connection to the opposite end of the track portions. The joint members J30*a* and J30*b* are running through the rear side portion of the second intermediate element 142C so as to attach the first and second connection portions 330*a*, 330*b* to the second intermediate element 142C. The first and second joint members may e.g. be screw joint members. The first and second joint members are thus configured to attach the track portions to the second intermediate element 142C, the first joint member and second joint member being attached at a distance from the central portion of the rear end portion of the second intermediate element 142C on opposite sides of said central portion.

According to an aspect of the present disclosure the set of track member portions 310, 320, 330, 340, 350 comprises a third intermediate track member portion 340 arranged in connection to the third intermediate element 142D. The third intermediate track member portion 340 arranged in connection to the rear side of the third intermediate element 142D.

According to an aspect of the present disclosure the third intermediate track member portion 340 has a first connection portion 340*a* configured to project towards the second intermediate element 142C and hence towards the second intermediate track member portion 330. According to an aspect of the present disclosure the first connection portion 340*a* is configured to project towards the rear side portion of the second intermediate element 142C a part of the distance between the third intermediate element 142D and the second intermediate element 142C in a direction essentially corresponding to the axial extension of the shaft 144.

According to an aspect of the present disclosure the third intermediate track member portion 340 has a second connection portion 340*b* configured to project towards the second end element 142E and hence towards the second end track member portion 350. According to an aspect of the present disclosure the second connection portion 340*b* is configured to project towards the rear side portion of the second end element 142E a part of the distance between the third intermediate element 142D and the second end element 142E in a direction essentially corresponding to the axial extension of the shaft 144.

According to an aspect of the present disclosure the first connection portion 340*a* of the third intermediate track member portion 340 comprises a track portion having a track T40*a*. According to an aspect of the present disclosure, the track portion with the track T40*a* is configured to run in a direction essentially parallel to the extension of the rear side portion of the third intermediate element 142D at a certain distance from the rear side portion of the third intermediate element 142D. The track T40*a* of the track portion of the first connection portion 340*a* of the third intermediate track member portion 340 is configured to face the track T30*b* of the track portion of the second connection portion 330*b* of the second intermediate track member portion 330.

The track T40*a* of the track portion is running in a direction essentially orthogonal to the extension of the shaft 144 and essentially orthogonal to the extension of the intermediate portion of the third intermediate element 142D.

According to an aspect of the present disclosure the second connection portion 340*b* of the third intermediate track member portion 340 comprises a track portion having a track T40*b*. According to an aspect of the present disclosure, the track portion with the track T20 is configured to run in a direction essentially parallel to the extension of the rear side portion of the third intermediate element 142D at a certain distance from the rear side portion of the third intermediate element 142D. The track T40*b* of the track portion of the second connection portion 340*b* of the third intermediate track member portion 340 is configured to face a track of a track portion of the second end track member portion 350.

The track T40*b* of the track portion is running in a direction essentially orthogonal to the extension of the shaft 144 and essentially orthogonal to the extension of the intermediate portion of the third intermediate element 142D.

According to an aspect of the present disclosure the third intermediate track member portion 340 with the first connection portion 340*a* and second connection portion 340*b* is attached to the rear side portion of the third intermediate element 142D by means of a first joint member J40*a* in connection to one end of the track portions and a second joint member J40*b* in connection to the opposite end of the track portions. The joint members J40*a* and J40*b* are running through the rear side portion of the third intermediate element 142D so as to attach the first and second connection portions 340*a*, 340*b* to the third intermediate element 142D. The first and second joint members may e.g. be screw joint members. The first and second joint members are thus configured to attach the track portions to the second intermediate element 142C, the first joint member and second joint member being attached at a distance from the central portion of the rear end portion of the second intermediate element 142C on opposite sides of said central portion.

According to an aspect of the present disclosure the set of track member portions 310, 320, 330, 340, 350 comprises a second end track member portion 350 arranged in connection to the second end element 142E. The second end track member portion 350 arranged in connection to the rear side of the second end element 142E.

According to an aspect of the present disclosure the second end track member portion 350 is configured to project towards the third intermediate element 142D. According to an aspect of the present disclosure the second end track member portion 350 is configured to project towards the rear side portion of the third intermediate element 142D a part of the distance between the second end element 142E and the third intermediate element 142D in a direction essentially corresponding to the axial extension of the shaft 144.

According to an aspect of the present disclosure the second end track member portion 350 comprises a track portion having a track T50. According to an aspect of the present disclosure, the track portion with the track T50 is configured to run in a direction essentially parallel to the extension of the rear side portion of the second end element 142E at a certain distance from the rear side portion of the second end element 142E. According to an aspect of the present disclosure the second end track member portion 350 is attached to the rear side portion of the second end element 142E by means of a first joint member J50*a* in connection to one end of the track portion and a second joint member J50*b* in connection to the opposite end of the track portion. The first and second joint members may e.g. be screw joint members. The first and second joint members are thus configured to attach the track portion to the second end element 142E, the first joint member and second joint member being attached at a distance from the central portion of the rear end portion of the second end element 142E on opposite sides of said central portion.

The track T50 of the track portion is running in a direction essentially orthogonal to the extension of the shaft 144 and essentially orthogonal to the extension of the intermediate portion of the second end element 142E.

The rotation limit arrangement 300 comprises a set of distance members J12, J23, J34, J45 configured to connect said set of track member portions 310, 320, 330, 340, 350 of the rotation limit arrangement 300 so as to limit the rotation of the individual elements 142A, 142B, 142C, 142D, 142E about the shaft 144 of the feeding chute 140.

Said set of distance members J12, J23, J34, J45 are thus configured to connect said set of elements 142 so as to limit the rotation of the individual elements 142A, 142B, 142C, 142D, 142E about the shaft 144 of the feeding chute 140.

Said set of distance members J12, J23, J34, J45 are thus configured to connect said set of elements 142 by means of connecting said set of track member portions 310, 320, 330, 340, 350 so as to limit the rotation of the individual elements 142A, 142B, 142C, 142D, 142E about the shaft 144 of the feeding chute 140.

Said set of distance members J12, J23, J34, J45 are according to an aspect of the present disclosure configured to connect said set of track member portions 310, 320, 330, 340, 350 of the rotation limit arrangement 300 so as to hold the individual elements 142A, 142B, 142C, 142D, 142E together in the axial direction, i.e. direction of the shaft 144.

Said set of distance members J12, J23, J34, J45 are thus according to an aspect of the present disclosure configured to connect said set of elements 142 so as to hold the individual elements 142A, 142B, 142C, 142D, 142E together in th axial direction, i.e. direction of the shaft 144.

Said set of distance members J12, J23, J34, J45 have according to an aspect of the present disclosure a longitudinal extension. Said set of distance members J12, J23, J34, J45 have according to an aspect of the present disclosure a joint member configuration. Said set of distance members J12, J23, J34, J45 have according to an aspect of the present disclosure a cylindrical configuration. Said set of distance members J12, J23, J34, J45 have according to an aspect of the present disclosure a longitudinal extension so as to reach through two tracks of track portions facing each other, i.e. tracks of adjacent track member portions. Said set of distance members J12, J23, J34, J45 are according to an aspect of the present disclosure configured to be movable along said tracks in the longitudinal extension of said tracks. Said set of distance members J12, J23, J34, J45 are according to an aspect of the present disclosure configured to connect adjacent track portions so as to essentially prevent relative movement of the track portions in the axial direction, i.e. direction orthogonal to the longitudinal extension of the tracks and thus axial direction of the distance member. Said set of distance members J12, J23, J34, J45 have according to an aspect of the present disclosure stop members so as to hold adjacent tack member portions in the axial direction, i.e. axial extension of the shaft, and thereby keep the certain distance between adjacent elements associated with those track member portions.

Individual distance members of said set of distance members J12, J23, J34, J45 are configured to connect facing track portions of adjacent track member portions by being movably and connectably arranged in connection to the facing tracks of the track portions facing each other.

Individual distance members of said set of distance members J12, J23, J34, J45 are configured to run through facing tracks of facing track portions of adjacent track member portions so as to connect said facing track portions and allow relative movement of said facing track portions in the direction of said tracks by allowing limited movement of the distance member between opposite end portions of tracks facing each other. By thus allowing limited movement of the distance member between opposite end portions of tracks facing each other, limited movement of the tracks facing each other are allowed, thus providing limited rotation of the adjacent elements to which said adjacent track members portions are attached.

Individual distance members of said set of distance members J12, J23, J34, J45 are configured to run through facing tracks of facing track portions of adjacent track member portions so as to connect said facing track portions and essentially prevent relative movements of said facing track portions in the direction of said distance member and hence in the axial direction by providing stop members at the distance member so as to prevent movement of the distance member through the respective track of the tracks facing each other.

Said set of distance members J12, J23, J34, J45 comprises a first distance member J12. The first distance member J12 is configured to connect the first end track member portion 310 and first intermediate track member portion 320 so as to provide a limit of the rotation of the first end element 142A and first intermediate element 142B relative to each other about the shaft 144. The first distance member J12 is configured run through the track T10 of the first end track member portion 310 and the track T20*a* of the first connection portion 320*a* of the first intermediate track member portion 320 so as to connect the first end element 142A and first intermediate element 142B and allowing limited relative rotational movement of said elements 142A, 142B about said shaft 144 by means of allowing said distance member J12 to move within said tracks T10, T20A. The first distance member J12 is configured run through the track T10 and the track T20*a* so as to connect the first end element 142A and first intermediate element 142B, and essentially prevent relative movement in a direction essentially corresponding to the axial direction of the shaft 144 by means of stop members of said first distance member J12.

Said set of distance members J23, J23, J34, J45 comprises a second distance member J23. The second distance member J23 is configured to connect the first intermediate track member portion 320 and second intermediate track member portion 330 so as to provide a limit of the rotation of the first intermediate element 142B and second intermediate element 142C relative to each other about the shaft 144. The second distance member J23 is configured run through the track T20*b* of the second connection portion 320*b* of the first intermediate track member portion 320 and the track T30*a* of the first connection portion 330*a* of second intermediate track member portion 330 so as to connect the first intermediate element 142B and second intermediate element 142C and allowing limited relative rotational movement of said elements 142B, 142C about said shaft 144 by means of allowing said distance member J23 to move within said tracks T20*b*, T30*a*. The second distance member J23 is configured run through the track T20*b* and the track T30*a* so as to connect the first intermediate element 142B and second intermediate element 142C, and essentially prevent relative movement in a direction essentially corresponding to the axial direction of the shaft 144 by means of stop members of said second distance member J23.

Said set of distance members J23, J23, J34, J45 comprises a third distance member J34. The third distance member J34 is configured to connect the second intermediate track member portion 330 and third intermediate track member portion 340 so as to provide a limit of the rotation of the second intermediate element 142C and third intermediate element 142D relative to each other about the shaft 144. The third distance member J34 is configured run through the track T30*b* of the second connection portion 330*b* of the second intermediate track member portion 330 and the track T40*a* of the first connection portion 340*a* of third intermediate track member portion 340 so as to connect the second intermediate element 142C and third intermediate element 142D and allowing limited relative rotational movement of said elements 142C, 142D about said shaft 144 by means of allowing said distance member J34 to move within said tracks T30*b*, T40*a*. The third distance member J34 is configured run through the track T30*b* and the track T40*a* so as to connect the second intermediate element 142C and third intermediate element 142D, and essentially prevent relative movement in a direction essentially corresponding to the axial direction of the shaft 144 by means of stop members of said third distance member J34.

Said set of distance members J23, J23, J34, J45 comprises a fourth distance member J45. The fourth distance member J45 is configured to connect the third intermediate track member portion 340 and second end track member portion 350 so as to provide a limit of the rotation of the third intermediate element 142D and second end element 142E relative to each other about the shaft 144. The fourth distance member J45 is configured run through the track T40*b* of the second connection portion 340*b* of the third intermediate track member portion 340 and the track T50 of the second end track member portion 350 so as to connect the third intermediate element 142D and second end element 142E and allowing limited relative rotational movement of said elements 142D, 142E about said shaft 144 by means of allowing said distance member J45 to move within said tracks T40*b*, T50. The fourth distance member J45 is configured run through the track T40*b* and the track T50 so as to connect the third intermediate element 142D and second end element 142E, and essentially prevent relative movement in a direction essentially corresponding to the axial direction of the shaft 144 by means of stop members of said fourth distance member J45.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

Below some aspects of the arrangement for feeding ammunition to a weapon and the vehicle according to the present disclosure are listed, which aspects particularly relate to the gliding arrangement 200.

An arrangement for feeding ammunition A to a weapon 20, the weapon 20 being mounted to an elevation device 30 arranged to allow elevation movement of the weapon 20 about an elevation axis Z1, the arrangement comprising a feeding chute 140 comprising one or more channels C1, C2 through which ammunition A is configured to be fed, the feeding chute having a connection side 140*e* for connecting the feeding chute to the weapon 20, and an opposite receiving side 140*f* for receiving the ammunition to be fed through the feeding chute 140, the feeding chute 140 comprising a set of elements 142 assembled together so as to provide said at least one channel C1, C2, wherein the set of elements 142 is arranged about a shaft 144 configured to be concentrically arranged relative to the elevation axis Z1 so as to allow movement of individual elements of the set of elements 142 about said shaft 144 in connection to elevation movement of the weapon 20 about the elevation axis Z1, individual elements of said set of elements being gradually mutually displaceable, wherein the individual elements movable about said shaft 144 are configured to be arranged a certain distance in the axial direction of said shaft 144 relative to adjacent elements, wherein the feeding chute comprises a gliding arrangement 200 arranged in connection to the individual elements 142A, 142B, 142C, 142D, 142E so as to facilitate feeding of ammunition through the respective individual elements of the feeding chute 140.

The arrangement according to aspect 1A, wherein the gliding arrangement 200 comprises a set of gliding members 210, 220, 230, 240, 250, 260, 270, 280 arranged at a distance from each other within the at least one channel C1, C2 of the feeding chute 140.

The arrangement according to aspect 2A, wherein set of gliding members 210, 220, 230, 240, 250, 260, 270, 280 are configured to run in the feeding direction as to facilitate feeding of ammunition through the respective individual elements 142A, 142B, 142C, 142D, 142E of the feeding chute 140.

The arrangement according to aspect 2A or 3A, wherein individual gliding members of the set of gliding members 210, 220, 230, 240, 250, 260, 270, 280 have a longitudinal extension and are configured to run in a direction essentially corresponding to the axial direction of the shaft so as to facilitate feeding of ammunition through the respective individual elements 142A, 142B, 142C, 142D, 142E of the feeding chute 140.

The arrangement according to any of aspects 2A-4A, wherein the gliding arrangement 200 comprises upper and lower gliding members, upper gliding members being configured to be arranged in the upper part of a channel of the feeding chute 140 and lower gliding members being configured to be arranged in the lower part of a channel of the feeding chute 140.

The arrangement according to any of aspects 2A-5A, wherein individual gliding members of the gliding arrangement 200 comprises gliding rails overlappingly arranged so as to allow relative movement of said gliding rails for facilitating gradual mutual displacement of individual feeding elements of the set of elements 142 when rotated about said shaft 144.

The arrangement according to aspect 6A, wherein individual gliding rails of individual gliding members are attached to one feeding element so that said gliding rails are allowed to move relative to each other based on rotational movement of individual feeding elements 142A, 142B, 142C, 142D, 142E about said shaft 144.

The arrangement according to aspect 6A or 7A, wherein the set of elements 142 of the feeding chute 140 comprises a first end element 142A configured to be closest to the weapon 20 in connection to the connection side 140*e*, a second end element 142E configured to be furthest away from the weapon 20 in connection to the receiving side 140*f*, and intermediate elements 142B, 142C, 142D arranged between the first and second end elements, wherein individual gliding rails of individual gliding members arranged in connection to the connection side are attached to the first end element 142A and individual gliding rails of individual gliding members arranged in connection to the receiving side are attached to the second end element 142E so that said gliding rails of individual gliding members are allowed to move relative to each other based on rotational movement of individual feeding elements 142A, 142B, 142C, 142D, 142E about said shaft 144.

The arrangement according to aspect 8A, wherein gliding rails of individual gliding members arranged between gliding rails attached to the first end element 142A and gliding rails attached to the second end element 142E are attached to an intermediate feeding element so that said gliding rails of individual gliding members are allowed to move relative to each other based on rotational movement of individual feeding elements 142A, 142B, 142C, 142D, 142E about said shaft 144.

The arrangement according to any of aspects 6A-9A, wherein individual gliding rails of individual gliding members have a gliding surface configured to face the ammunition during feeding of ammunition through the feeding chute 140.

The arrangement according to any of aspects 6A-10A, wherein the number of individual gliding rails of individual gliding members are based on the range between the maximum elevation angle and minimum elevation angle of the weapon.

The arrangement according to any of aspects 6A-11A, wherein the number of individual gliding rails of individual gliding members are based on the range of the degree of rotational movement of the individual feeding elements 142A, 142B, 142C, 142D, 142E about said shaft 144.

The arrangement according to any of aspects 6A-12A, wherein individual gliding members of the gliding arrangement 200 comprises guide rails being arranged in connection to gliding rails of a gliding member so as to guide and control movement of the gliding rails.

The arrangement according to aspect 13A, wherein guide rails of individual gliding members being arranged in connection to gliding rails of that gliding member are configured to run through openings of elements of the set of elements 142.

The arrangement according to aspect 13A or 14A, wherein individual gliding members of the gliding arrangement 200 comprises a pair of guide rails being overlappingly arranged in connection to the gliding rails of that gliding member so as to guide and hence control movement of the gliding rails of that gliding member.

The arrangement according to aspect 15A, wherein a first of said pair of guide rails is configured to be fixedly connected to the first end element 142A and a second of said pair of guide rails is configured to be fixedly connected to the second end element 142E, said pair of guide rails being overlappingly arranged in connection to an intermediate element, said pair of guide rails being movably arranged relative to each other in connection to an opening of said intermediate element through which said pair of guide rails are configured to run.

The arrangement according to aspect 15A or 16A, wherein pair of guide rails of individual gliding members has tracks in connection to a portion of said pair guide rails where overlapping of said pair of guide rails is intended, the track of the respective guide rail of said pair of guide rails being arranged so as to allow limited relative rotational movement of said set of elements 142 about said shaft 144.

The arrangement according to any of aspects 15A-17A, wherein a joint member running through the opening of said intermediate element, said joint member being configured to attach a gliding rail arranged between gliding rails attached to the first end element 142A and gliding rails attached to the second end element 142E, is configured to provide a stop for the respective guide rail by acting against the respective end of the respective track of the pair of guide rails.

The arrangement according to any of aspects 1A-18A, wherein the feeding chute 140, at the end opposite to the end connected to the weapon 20, is configured to be fixedly attached to a guiding chute 50, 60 for guiding the ammunition A from a magazine to the feeding chute 140.

The arrangement according to any of aspects 8A-19A, wherein the first end element 142A is configured to be pivoted about the shaft 144 corresponding to the elevation movement of the weapon 20 about the elevation axis Z1.

The arrangement according to any of aspects 8A-20A, wherein the second end element 142E is configured to be essentially fixed so that it is at the same position independently of elevation angle of the weapon 20 thus connected to the feeding chute 140.

The arrangement according to any of aspects 8A-21A, wherein the second end element 142E furthest away from the weapon 20 is configured to have an angle β within a range between the maximum elevation angle α1 and minimum elevation angle α2 of the weapon 20.

The arrangement according to any of aspects 1A-22A, wherein the feeding chute 140 comprises an upper channel C1 for feeding ammunition A and a lower channel C2 for feeding ammunition A, said shaft 144 being arranged between the upper and lower channel.

The arrangement according to any of aspects 1A-23A, wherein the ammunition A is configured to be guided from an essentially upright position in the magazine to an essentially lying position at the feeding chute via a guiding chute.

The arrangement according to any of aspects 1A-24A, wherein the arrangement is intended for a vehicle mounted weapon system C, the weapon system S comprising the weapon 20 mounted to a turret 10 via the elevation device 30.

Below some aspects of the arrangement for feeding ammunition to a weapon and the vehicle according to the present disclosure are listed, which aspects particularly relate to the rotation limit arrangement 40*t*, 48; 300.

An arrangement for feeding ammunition A to a weapon 20, the weapon 20 being mounted to an elevation device 30 arranged to allow elevation movement of the weapon 20 about an elevation axis Z1, the arrangement comprising a feeding chute 40; 140, the feeding chute having a connection side 40*e*; 140*e* for connecting the feeding chute to the weapon 20, and an opposite receiving side 40*f*; 140*f*, the feeding chute having a front side 40*c*; 140*c* essentially facing the firing direction of the weapon, when the feeding chute is connected to the weapon 20, and an opposite rear side 40*d*; 140*d* the feeding chute 40; 140 comprising a set of elements 42; 142 assembled together, wherein the set of elements 42; 142 is arranged about a shaft 44; 144 configured to be concentrically arranged relative to the elevation axis Z1 so as to allow movement of individual elements of the set of elements 42; 142 about said shaft 44; 144 in connection to elevation movement of the weapon 20 about the elevation axis Z1, the arrangement comprising a rotation limit arrangement 40*t*, 48; 300 arranged in connection to the front side or rear side of the feeding chute configured to limit rotation of the individual elements about said shaft 44; 144.

The arrangement according to aspect 1B, wherein the rotation limit arrangement comprises tracks in connection to individual elements of said set of elements, said tracks running in a direction essentially orthogonal to the extension of the shaft 144 so as to facilitate said limited rotation of the individual elements about said shaft 44; 144.

The arrangement according to aspect 1B or 2B, wherein the rotation limit arrangement comprises a set of distance members 48; J12, J23, J34, J45 configured to connect said set of elements 142 so as to limit the rotation of the individual elements about said shaft 44; 144.

The arrangement according to aspect 3B, wherein said set of distance members 48; J12, J23, J34, J45 are configured to connect said set of elements 142 so as to hold the individual elements of the set of elements together in the axial direction of the shaft.

The arrangement according to any of aspects 1B-4B, wherein the individual elements movable about said shaft 44 are configured to be tightly arranged in the axial direction of said shaft 44 relative to adjacent elements, wherein the rotation limit arrangement comprises a track member 40*t* being configured to run through the set of elements 42 so as to limit the rotation of the individual elements about the shaft 44.

The arrangement according to aspect 5B, wherein the track member 40*t* comprises said tracks, said tracks being arranged to run through the individual elements of said set of elements 42, the respective track running in a direction essentially orthogonal to the extension of the shaft so as to limit the rotation of the individual elements about the shaft 44.

The arrangement according to aspect 5B or 6B, wherein the track of the respective individual element is alternatingly displaced relative to adjacent elements so as to facilitate connection of adjacent elements by means of individual distance members for limiting rotation of the individual elements about the shaft 44.

The arrangement according to any of aspects 5B-7B, wherein individual distance members 48 of said set of distance members 48 are configured to be movably connected to a track of an individual element and fixedly connect to the adjacent individual element so as to limit the rotation of the individual elements about the shaft 44.

The arrangement according to any of aspects 1B-4B, wherein the individual elements movable about said shaft 144 are configured to be arranged a certain distance in the axial direction of said shaft 144 relative to adjacent elements, wherein the rotation limit arrangement 300 comprises a set of track member portions 310, 320, 330, 340, 350, each individual track member portion 310, 320, 330, 340, 350 of the set of track member portions 310, 320, 330, 340, 350 is arranged in connection to an individual element 142A, 142B, 142C, 142D, 142E of the set of elements 142 of the feeding chute 140.

The arrangement according to aspect 9B, wherein the set of track member portions 310, 320, 330, 340, 350 comprises tracks, the tracks of the respective track member portions 310, 320, 330, 340, 350 being arranged at a distance from the individual element to which it is connected and at a distance from an individual element adjacent to the individual element to which it is connected and within the certain distance between those elements.

The arrangement according to aspect 9B or 10B, wherein the set of distance members J12, J23, J34, J45 of the rotation limit arrangement 300 are configured to connect said set of track member portions 310, 320, 330, 340, 350 of the rotation limit arrangement 300 so as to limit the rotation of the individual elements 142A, 142B, 142C, 142D, 142E about the shaft 144 of the feeding chute 140.

The arrangement according to aspect 10B or 11B, wherein adjacent track member portions of said set of set of track member portions 310, 320, 330, 340, 350 have track provided track portions facing each other, wherein individual distance members of said distance members J12, J23, J34, J45 are configured to connect facing track portions of adjacent track member portions by being movably and connectably arranged in connection to the facing tracks of the track portions facing each other.

The arrangement according to any of aspects 10B-12B, wherein individual distance members of said set of distance members J12, J23, J34, J45 are configured to run through facing tracks of facing track portions of adjacent track member portions so as to connect said facing track portions and allow relative movement of said facing track portions in the direction of said tracks by allowing limited movement of the distance member between opposite end portions of tracks facing each other.

The arrangement according to any of aspects 10B-13B, wherein individual distance members of said set of distance members J12, J23, J34, J45 are configured to run through facing tracks of facing track portions of adjacent track member portions so as to connect said facing track portions and essentially prevent relative movements of said facing track portions in the direction of said distance member and hence in the axial direction by providing stop members at the distance member so as to prevent movement of the distance member through the respective track of the tracks facing each other.

The arrangement according to any of aspects 1B-14B, wherein the feeding chute 40; 140, at the end opposite to the end connected to the weapon 20, is configured to be fixedly attached to a guiding chute 50, 60 for guiding the ammunition A from a magazine M to the feeding chute 40; 140.

The arrangement according to any of aspects 1B-15B, wherein the feeding chute 40; 140 comprises a first end element 42*e*1; 142A configured to be closest to the weapon 20, the first end element being configured to be pivoted about the shaft 44; 144 corresponding to the elevation movement of the weapon 20 about the elevation axis Z1.

The arrangement according to any of aspects 1B-16B, wherein the feeding chute 40; 140 comprises a second end element 42*e*2; 142E configured to be furthest away from the weapon 20, the second end element 42*e*2; 142E being configured to be essentially fixed so that it is at the same position independently of elevation angle of the weapon 20 thus connected to the feeding chute 40; 140.

The arrangement according to any of aspects 1B-17B, wherein the individual elements movable about said shaft 44; 144 are configured to be rotated about the shaft 44; 144 a certain angle relative to an adjacent element so as to allow feeding of ammunition A through the feeding chute 40; 140 at all elevation angles of the elevation device 30.

The arrangement according to any of aspects 1B-18B, wherein the feeding chute 40; 140 comprises an upper channel for feeding ammunition A and a lower channel for feeding ammunition A, said shaft 44; 144 being arranged between the upper and lower channel.

The arrangement according to any of aspects 1B-19B, wherein the arrangement is intended for a vehicle mounted weapon system C, the weapon system comprising the weapon 20 mounted to a turret 10 via the elevation device 30.

The invention claimed is:

1. An arrangement for feeding ammunition to a weapon, the weapon being mounted to an elevation device arranged to allow elevation movement of the weapon about an elevation axis, the arrangement comprising a feeding chute connected at one end to the weapon, the feeding chute comprising a set of elements assembled together in a stacked configuration, wherein the set of elements is arranged about a shaft configured to be concentrically arranged relative to the elevation axis so as to allow movement of individual elements of the set of elements about said shaft in connection to elevation movement of the weapon about the elevation axis, wherein the feeding chute having a connection side for connecting the feeding chute to the weapon, and an opposite receiving side, the feeding chute having a front side essentially facing the firing direction of the weapon, when the feeding chute is connected to the weapon, and an opposite rear side, wherein the arrangement comprises a rotation limit arrangement arranged in connection to the front side or rear side of the feeding chute configured to limit rotation of the individual elements about said shaft, wherein the rotation limit arrangement comprises tracks in connection to individual elements of said set of elements, said tracks running in a direction essentially orthogonal to the extension of the shaft so as to facilitate said limited rotation of the individual elements about said shaft.

2. The arrangement according to claim 1, wherein the feeding chute, at the end opposite to the end connected to the weapon, is configured to be fixedly attached to a guiding chute for guiding the ammunition from a magazine to the feeding chute.

3. The arrangement according to claim 1, wherein the feeding chute comprises a first end element configured to be closest to the weapon, the first end element being configured to be pivoted about the shaft corresponding to the elevation movement of the weapon about the elevation axis.

4. The arrangement according to claim 1, wherein the feeding chute comprises a second end element configured to be furthest away from the weapon, the second end element being configured to be essentially fixed so that it is at the same position independently of elevation angle of the weapon thus connected to the feeding chute.

5. The arrangement according to claim 4, wherein the elements of the set of elements between the first end element and the second end element are gradually mutually displaceable.

6. The arrangement according to claim 1, wherein the individual elements movable about said shaft are configured to be rotated about the shaft a certain angle relative to an adjacent element so as to allow feeding of ammunition through the feeding chute at all elevation angles of the elevation device.

7. The arrangement according to claim 1, the feeding chute being configured to provide at least one channel by means of said elements, through which at least one channel ammunition is configured to be fed, wherein the individual elements movable about said shaft are configured to be arranged a certain distance relative to each other in the axial direction of said shaft, wherein the feeding chute comprises a gliding arrangement comprising a set of gliding members arranged in connection to the individual elements and configured to run in the feeding direction so as to facilitate feeding of ammunition through the respective individual elements of the feeding chute.

8. The arrangement according to claim 7, wherein individual gliding members of the gliding arrangement comprises gliding rails overlappingly arranged in connection to individual elements so as to allow relative movement of said gliding rails for facilitating gradual mutual displacement of individual elements of the set of elements when rotated about said shaft.

9. The arrangement according to claim 1, wherein the rotation limit arrangement comprises a set of distance members configured to connect said set of elements so as to limit the rotation of the individual elements about said shaft.

10. The arrangement according to claim 4, wherein the second end element furthest away from the weapon is configured to have an angle within a range between the maximum elevation angle and minimum elevation angle of the weapon.

11. The arrangement according to claim 1, wherein the set of elements are pivotably journalled about said shaft.

12. The arrangement according to claim 1, wherein the feeding chute comprises an upper channel for feeding ammunition and a lower channel for feeding ammunition, said shaft being arranged between the upper and lower channel.

13. The arrangement according to claim 1, wherein the feeding chute, in connection to said one end of the feeding chute, comprises a fastening arrangement for attaching the feeding chute to the weapon.

14. The arrangement according to claim 2, wherein the ammunition is configured to be guided from an essentially upright position in the magazine to an essentially lying position at the feeding chute via the guiding chute.

15. The arrangement according to claim 1, wherein the arrangement is intended for a vehicle mounted weapon system, the weapon system comprising the weapon mounted to a turret via the elevation device.

16. The arrangement according to claim 2, wherein the arrangement comprising the feeding chute, and the guiding chute to which the feeding chute is connected are configured to be arranged within a turret of a vehicle mounted weapon system for which the arrangement is intended, the weapon system comprising the weapon mounted to a turret via the elevation device.

17. A vehicle comprising an arrangement for feeding ammunition from a magazine to a weapon of a weapon system mounted on the vehicle according to claim 1.

18. The vehicle according to claim 17, wherein the vehicle is a tracked vehicle.

19. An arrangement for feeding ammunition to a weapon, the weapon being mounted to an elevation device arranged to allow elevation movement of the weapon about an elevation axis, the arrangement comprising a feeding chute connected at one end to the weapon, the feeding chute comprising a set of elements assembled together in a stacked configuration, wherein the set of elements is arranged about a shaft configured to be concentrically arranged relative to the elevation axis so as to allow movement of individual elements of the set of elements about said shaft in connection to elevation movement of the weapon about the elevation axis, wherein the feeding chute comprises an upper channel for feeding ammunition and a lower channel for feeding ammunition, said shaft being arranged between the upper and lower channel.

20. The arrangement according to claim 19, wherein the feeding chute, at the end opposite to the end connected to the weapon, is configured to be fixedly attached to a guiding chute for guiding the ammunition from a magazine to the feeding chute.

21. The arrangement according to claim 19, wherein the feeding chute comprises a first end element configured to be closest to the weapon, the first end element being configured to be pivoted about the shaft corresponding to the elevation movement of the weapon about the elevation axis.

22. The arrangement according to claim 19, wherein the feeding chute comprises a second end element configured to be furthest away from the weapon, the second end element being configured to be essentially fixed so that it is at the same position independently of elevation angle of the weapon thus connected to the feeding chute.

23. The arrangement according to claim 22, wherein the elements of the set of elements between the first end element and the second end element are gradually mutually displaceable.

24. The arrangement according to claim 19, wherein the individual elements movable about said shaft are configured to be rotated about the shaft a certain angle relative to an adjacent element so as to allow feeding of ammunition through the feeding chute at all elevation angles of the elevation device.

25. The arrangement according to claim 19, the feeding chute being configured to provide at least one channel by means of said elements, through which at least one channel ammunition is configured to be fed, wherein the individual elements movable about said shaft are configured to be arranged a certain distance relative to each other in the axial direction of said shaft, wherein the feeding chute comprises a gliding arrangement comprising a set of gliding members arranged in connection to the individual elements and configured to run in the feeding direction so as to facilitate feeding of ammunition through the respective individual elements of the feeding chute.

26. The arrangement according to claim 25, wherein individual gliding members of the gliding arrangement comprises gliding rails overlappingly arranged in connection to individual elements so as to allow relative movement of said gliding rails for facilitating gradual mutual displacement of individual elements of the set of elements when rotated about said shaft.

27. The arrangement according to claim 19, the feeding chute having a connection side for connecting the feeding chute to the weapon, and an opposite receiving side, the feeding chute having a front side essentially facing the firing direction of the weapon, when the feeding chute is connected to the weapon, and an opposite rear side, wherein the arrangement comprises a rotation limit arrangement arranged in connection to the front side or rear side of the feeding chute configured to limit rotation of the individual elements about said shaft, wherein the rotation limit arrangement comprises tracks in connection to individual elements of said set of elements, said tracks running in a direction essentially orthogonal to the extension of the shaft so as to facilitate said limited rotation of the individual elements about said shaft.

28. The arrangement according to claim 27, wherein the rotation limit arrangement comprises a set of distance members configured to connect said set of elements so as to limit the rotation of the individual elements about said shaft.

29. The arrangement according to claim 22, wherein the second end element furthest away from the weapon is configured to have an angle within a range between the maximum elevation angle and minimum elevation angle of the weapon.

30. The arrangement according to claim 19, wherein the set of elements are pivotably journalled about said shaft.

31. The arrangement according to claim 19, wherein the feeding chute, in connection to said one end of the feeding chute, comprises a fastening arrangement for attaching the feeding chute to the weapon.

32. The arrangement according to claim 20, wherein the ammunition is configured to be guided from an essentially upright position in the magazine to an essentially lying position at the feeding chute via the guiding chute.

33. The arrangement according to claim 19, wherein the arrangement is intended for a vehicle mounted weapon system, the weapon system comprising the weapon mounted to a turret via the elevation device.

34. The arrangement according to claim 20, wherein the arrangement comprising the feeding chute, and the guiding chute to which the feeding chute is connected are configured to be arranged within a turret of a vehicle mounted weapon system for which the arrangement is intended, the weapon system comprising the weapon mounted to a turret via the elevation device.

35. A vehicle comprising an arrangement for feeding ammunition from a magazine to a weapon of a weapon system mounted on the vehicle according to claim 19.

36. The vehicle according to claim 35, wherein the vehicle is a tracked vehicle.

* * * * *